US010825435B2

(12) United States Patent
Kamiya et al.

(10) Patent No.: US 10,825,435 B2
(45) Date of Patent: Nov. 3, 2020

(54) PIVOT MECHANISM AND KEYBOARD APPARATUS INCLUDING THE SAME

(71) Applicant: YAMAHA CORPORATION, Hamamatsu-shi (JP)

(72) Inventors: Hirotsugu Kamiya, Hamamatsu (JP); Shunsuke Ichiki, Hamamatsu (JP); Tsuyoshi Sato, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/550,627

(22) Filed: Aug. 26, 2019

(65) Prior Publication Data

US 2019/0378486 A1 Dec. 12, 2019

Related U.S. Application Data

(63) Continuation of application No. PCT/JP2018/010777, filed on Mar. 19, 2018.

(30) Foreign Application Priority Data

Mar. 24, 2017 (JP) ..... 2017-060193

(51) Int. Cl.
*G10H 1/34* (2006.01)
*G10C 3/12* (2006.01)

(52) U.S. Cl.
CPC ..... *G10H 1/346* (2013.01); *G10C 3/12* (2013.01)

(58) Field of Classification Search
CPC ..... G10H 1/346; G10C 3/12
See application file for complete search history.

(56) References Cited

U.S. PATENT DOCUMENTS

2013/0152769 A1* 6/2013 Suzuki ..... G10H 1/34 84/719

FOREIGN PATENT DOCUMENTS

| | | | |
|---|---|---|---|
| JP | S5378530 | A | 7/1978 |
| JP | 2000163062 | A | 6/2000 |
| JP | 2002207484 | A | 7/2002 |

OTHER PUBLICATIONS

International Search Report issued in Intl. Appln No. PCT/JP2018/010777 dated Jun. 5, 2018. English translation provided.
Written Opinion issued in Intl. Appln. No. PCT/JP2018/010777 dated Jun. 5, 2018. English translation provided.
International Preliminary Report on Patentability issued in Intl. Appln. PCT/JP2018/010777 dated Oct. 3, 2019. English translation provided.

* cited by examiner

*Primary Examiner* — Kimberly R Lockett
(74) *Attorney, Agent, or Firm* — Rossi, Kimms & McDowell LLP

(57) ABSTRACT

A pivot mechanism includes: a shaft portion; a bearing configured to contact the shaft portion and pivot about a pivot axis; and a reinforcement protruding from an outer circumferential surface of the shaft portion. The outer circumferential surface includes a first region contactable by the bearing in a range of its pivotal movement and a second region not including the first region in a region opposed to the first region via the pivot axis. The reinforcement extends from at least a portion of the second region to an outside of the bearing in a pivot-axis direction.

13 Claims, 14 Drawing Sheets

PIVOT MECHANISM AND KEYBOARD APPARATUS INCLUDING THE SAME

CROSS REFERENCE TO RELATED APPLICATION

The present application is a continuation application of International Application No. PCT/JP2018/010777, filed on Mar. 19, 2018, which claims priority to Japanese Patent Application No. 2017-060193, filed on Mar. 24, 2017. The contents of these applications are incorporated herein by in their entirety.

BACKGROUND

The present disclosure relates to a pivot mechanism. The present disclosure also relates to a keyboard apparatus including the pivot mechanism.

Keyboard instruments are constituted by a lot of components, resulting in a very complicated action mechanism for the components corresponding to pressing and releasing of each key. The action mechanism includes a pivot mechanism with which a lot of components are pivotably engaged.

For example, an action mechanism of an electronic keyboard instrument includes a hammer interlocked with a key in order to simulate and give a feeling of an acoustic piano to a player via the key. In response to pressing of the key, the hammer pivots with respect to a frame so as to raise a weight provided for the hammer. Such a pivot mechanism includes a shaft portion and a bearing. For example, Patent Document 1 (Japanese Patent Application Publication No. 2002-207484) discloses a hammer including a bearing opened in a round shape, and a frame including a shaft portion to which the bearing is fitted. Patent Document 2 (Japanese Patent Application Publication No. 2000-163062) discloses a hammer including a shaft portion shaped like a protrusion, and a bearing hole to which the shaft portion is rotatably fitted. In any case, the hammer is pivotably mounted on the frame by fitting the shaft portion and the bearing to each other.

SUMMARY

In the pivot mechanisms including the shaft portion and the bearing as in Patent Documents 1 and 2, the shaft portion serves as a pivot center of the pivotal movement, and thus heavy stress is applied to the shaft portion. In particular, the pivot mechanism using the hammer receives two actions, i.e., impacts received from pressing of the key and received from a stopper that stops pivotal movement of the hammer. Thus, heavy stress is applied to the shaft as the pivot center, which increases the importance of the strength and the stiffness of the shaft.

Accordingly, an aspect of the disclosure relates to improvement of the strength and the stiffness of a shaft to increase the durability of a pivot mechanism.

In one aspect of the disclosure, a pivot mechanism comprises: a shaft portion; a bearing configured to contact the shaft portion and pivot about a pivot axis; and a reinforcement protruding from an outer circumferential surface of the shaft portion, the outer circumferential surface comprising a first region contactable by the bearing in a range of pivotal movement thereof and a second region not comprising the first region in a region opposed to the first region via the pivot axis, the reinforcement extending from at least a portion of the second region to an outside of the bearing in a pivot-axis direction.

In another aspect of the disclosure, a pivot mechanism comprises: a shaft portion; a bearing configured to contact an outer circumferential surface of the shaft portion and pivot about a pivot axis; and a reinforcement protruding from the outer circumferential surface of the shaft portion in a direction orthogonal to a pivot-axis direction, wherein the reinforcement is configured such that a position, in the pivot-axis direction, of a boundary of a region in which the outer circumferential surface of the shaft portion contacts the bearing is located between a first end and a second end of the reinforcement in the pivot-axis direction.

In yet another aspect of the disclosure, a keyboard apparatus according to the present disclosure, comprises: a key; a hammer assembly configured to, in response to pressing of the key, pivot about a pivot mechanism comprising (i) a shaft portion, (ii) a bearing configured to contact the shaft portion and pivot about a pivot axis, and (iii) a reinforcement protruding from an outer circumferential surface of the shaft portion, the outer circumferential surface comprising a first region contactable by the bearing in a range of pivotal movement thereof and a second region not comprising the first region in a region opposed to the first region via the pivot axis, the reinforcement extending from at least a portion of the second region to an outside of the bearing in a pivot-axis direction; and a sound source section configured to produce a sound waveform signal in response to an output signal of the sensor.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENTS

Figure 1:
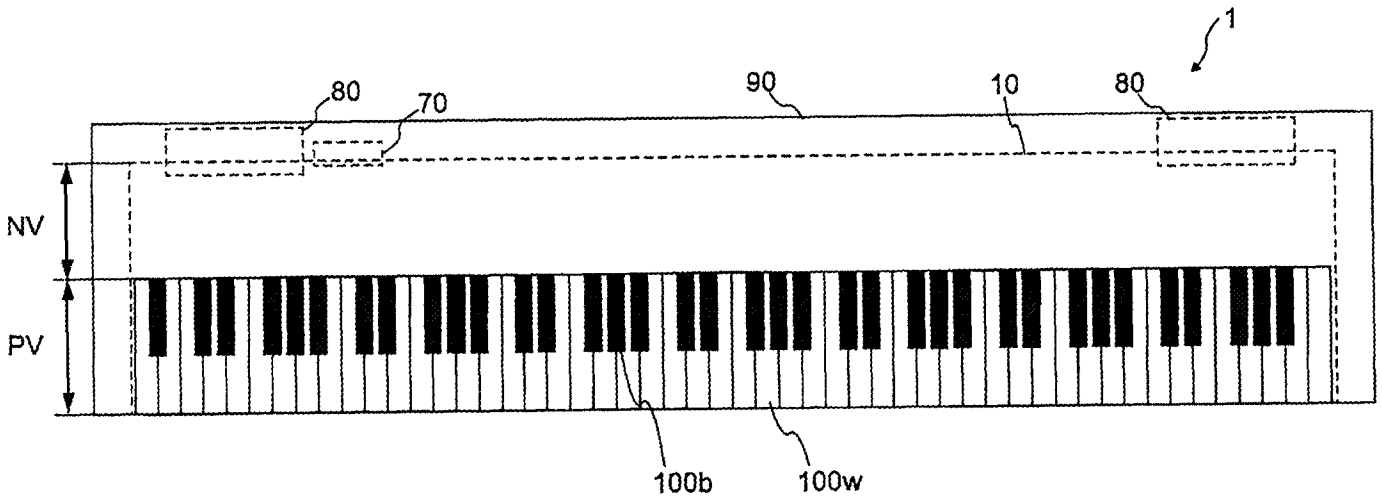
FIG. 1 is a view of a configuration of a keyboard apparatus in one embodiment of the present disclosure.

Hereinafter, there will be described embodiments of the present disclosure by reference to the drawings. It is to be understood that the following embodiments of the present disclosure are described by way of example, and the present disclosure should not be construed as limited to these embodiments. It is noted that the same or similar reference numerals (e.g., numbers with a character, such as A or B, appended thereto) may be used for components having the same or similar function in the following description and drawings, and an explanation of which may be dispensed with. The ratio of dimensions in the drawings (e.g., the ratio between the components and the ratio in the lengthwise, widthwise, and height directions) may differ from the actual ratio, and portions of components may be omitted from the drawings for easier understanding purposes. In the following explanation, pivotal movement means relative movement. For example, pivotal movement of a component A with respect to a component B means that the component B may pivot with respect to the fixed component A, that the component A may pivot with respect to the fixed component B conversely, and that the components A, B may pivot.

Directions used in the following description (a pivotal direction R and a yawing direction Y) will be defined. The pivotal direction R corresponds to a pivotal direction about an axis coinciding with a direction in which a hammer assembly 200 extends (a direction directed from the front side toward the back side when viewed by a player). The yawing direction Y is a direction curved in the right and left direction when the hammer assembly 200 is viewed from above. Movement of the hammer assembly 200 in the yawing direction Y corresponds to deformation (warp) in a scale direction S. It is noted that the pivotal direction R and the yawing direction Y for the hammer assembly 200 are the same as those for keys 100.

First Embodiment

Configuration of Keyboard Apparatus

FIG. 1 is a view of a configuration of a keyboard apparatus according to a first embodiment. In the present example, a keyboard apparatus 1 is an electronic keyboard instrument, such as an electronic piano, configured to produce a sound when a key is pressed by a user (a player). It is noted that the keyboard apparatus 1 may be a keyboard-type controller configured to output data (e.g., MIDI) for controlling an external sound source device, in response to key pressing. In this case, the keyboard apparatus 1 may include no sound source device.

The keyboard apparatus 1 includes a keyboard assembly 10. The keyboard assembly 10 includes white keys 100*w* and black keys 100*b*. The white keys 100*w* and the black keys 100*b* are arranged side by side. The number of the keys 100 is N and 88 in this example. A direction in which the keys 100 are arranged will be referred to as "scale direction". The white keys 100*w* and the black keys 100*b* may be hereinafter collectively referred to "the key 100" in the case where there is no need of distinction between the white keys 100*w* and the black keys 100*b*. Also in the following explanation, "w" appended to the reference number indicates a configuration corresponding to the white key. Also, "b" appended to the reference number indicates a configuration corresponding to the black key.

A portion of the keyboard assembly 10 is located in a housing 90. In the case where the keyboard apparatus 1 is viewed from an upper side thereof, a portion of the keyboard assembly 10 which is covered with the housing 90 will be referred to as "non-visible portion NV", and a portion of the keyboard assembly 10 which is exposed from the housing 90 and viewable by the user will be referred to as "visible portion PV". That is, the visible portion PV is a portion of the key 100 which is operable by the user to play the keyboard apparatus 1. A portion of the key 100 which is exposed by the visible portion PV may be hereinafter referred to as "key main body portion".

The housing 90 contains a sound source device 70 and a speaker 80. The sound source device 70 is configured to create a sound waveform signal in response to pressing of the key 100. The speaker 80 is configured to output the sound waveform signal created by the sound source device 70, to an outside space. It is noted that the keyboard apparatus 1 may include: a slider for controlling a sound volume; a switch for changing a tone color; and a display configured to display various kinds of information.

In the following description, up, down, left, right, front, and back (rear) directions respectively indicate directions in the case where the keyboard apparatus 1 is viewed from the player during playing. Thus, it is possible to express that the non-visible portion NV is located on a back side of the visible portion PV for example. Also, directions may be represented with reference to the key 100. For example, a key-front-end side (a key-front side) and a key-back-end side (a key-back side) may be used. In this case, the key-front-end side is a front side of the key 100 when viewed from the player. The key-back-end side is a back side of the key 100 when viewed from the player. According to this definition, it is possible to express that a portion of the black key 100*b* from a front end to a rear end of the key main body portion of the black key 100*b* is located on an upper side of the white key 100*w*.

Figure 2:
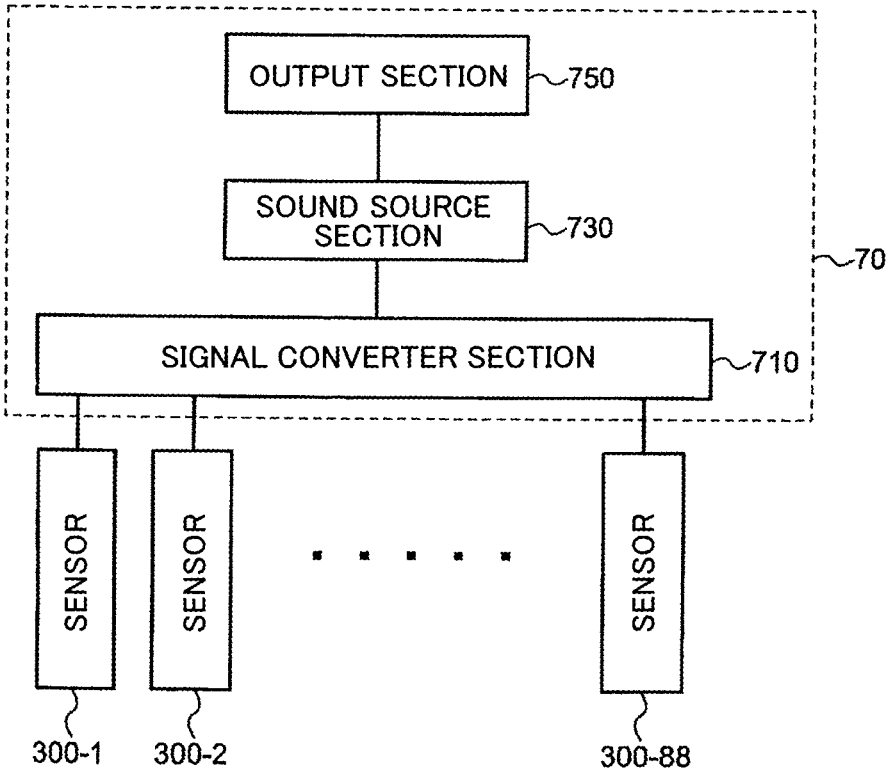
FIG. 2 is a block diagram illustrating a configuration of a sound source device in the one embodiment of the present disclosure.

FIG. 2 is a block diagram illustrating the configuration of the sound source device in the first embodiment. The sound source device 70 includes a signal converter section 710, a sound source section 730, and an output section 750. Sensors 300 are provided corresponding to the respective keys 100. Each of the sensors 300 detects an operation of a corresponding one of the keys 100 and outputs signals in accordance with the detection. In the present example, each of the sensors 300 outputs signals in accordance with three levels of key pressing amounts. The speed of the key pressing is detectable in accordance with a time interval between the signals.

The signal converter section 710 obtains the signals output from the sensors 300 (the sensors 300-1, 300-2, . . . , 300-88 corresponding to the respective 88 keys 100) and creates and outputs an operation signal in accordance with an operation state of each of the keys 100. In the present example, the operation signal is a MIDI signal. Thus, the signal converter section 710 outputs "Note-On" when a key is pressed. In this output, a key number indicating which one of the 88 keys 100 is operated, and a velocity corresponding to the speed of the key pressing are also output in association with "Note-On". When the player has released the key 100, the signal converter section 710 outputs the key number and "Note-Off" in association with each other. A signal created in response to another operation, such as an operation on a pedal, may be output to the signal converter section 710 and reflected on the operation signal.

The sound source section 730 creates the sound waveform signal based on the operation signal output from the signal converter section 710. The output section 750 outputs the sound waveform signal created by the sound source section 730. This sound waveform signal is output to the speaker 80 or a sound-waveform-signal output terminal, for example.

Configuration of Keyboard Assembly

Figure 3:
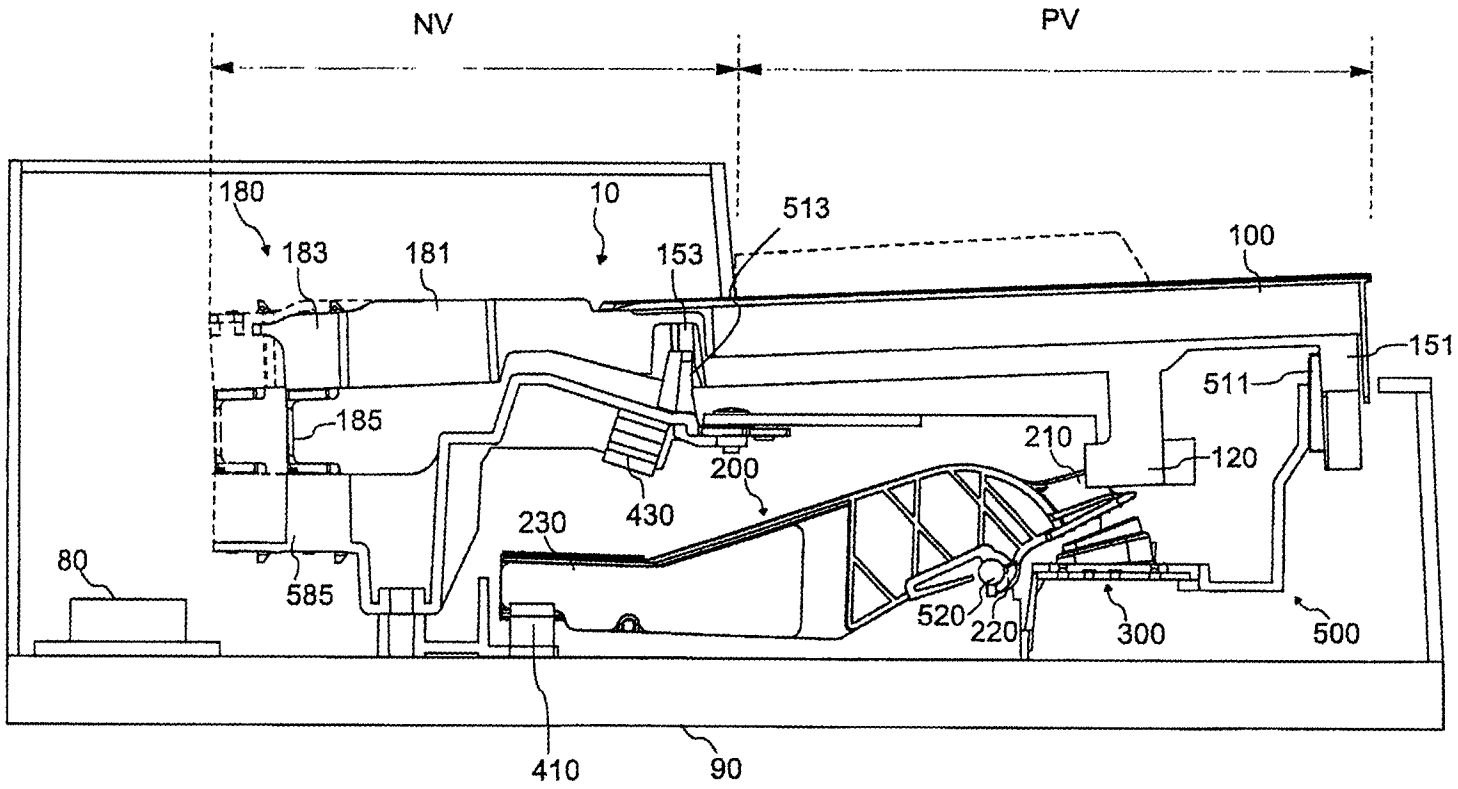
FIG. 3 is a view for explaining a configuration of the inside of a housing in the one embodiment of the present disclosure, with the configuration viewed from a lateral side of the housing.

FIG. 3 is a view of a configuration of the inside of the housing in the first embodiment, with the configuration viewed from a lateral side of the housing 90. As illustrated in FIG. 3, the keyboard assembly 10 and the speaker 80 are disposed in the housing 90. The speaker 80 is disposed at a back portion of the keyboard assembly 10. This speaker 80 is disposed so as to output a sound, which is produced in response to pressing of the key 100, toward up and down sides of the housing 90. The sound output downward travels toward the outside from a portion of the housing 90 near its lower surface. The sound output upward passes from the inside of the housing 90 through a space in the keyboard assembly 10 and travels to the outside from a space between the housing 90 and the keys 100 or from spaces each located between adjacent two of the keys 100 at the visible portion PV.

There will be next described a configuration of the keyboard assembly 10 with reference to FIG. 3. In addition to the keys 100, the keyboard assembly 10 includes connecting portions 180, the hammer assemblies 200, and the frame 500. The keyboard assembly 10 is formed of resin, and a most portion of the keyboard assembly 10 is manufactured by, e.g., injection molding. The frame 500 is fixed to the housing 90. The connecting portions 180 connect the respective keys 100 to the frame 500 such that the keys 100 are pivotable. The connecting portions 180 include plate-like flexible members 181, key-side supporters 183, and rod-like flexible members 185. Each of the plate-like flexible members 181 extends from a rear end of a corresponding one of the keys 100. Each of the key-side supporters 183 extends from a rear end of a corresponding one of the plate-like flexible members 181. Each of the rod-like flexible members 185 is supported by a corresponding one of the key-side supporters 183 and a frame-side supporter 585 of the frame 500. That is, the rod-like flexible members 185 is disposed between the key 100 and the frame 500. The key 100 pivots with respect to the frame 500 by bending of the rod-like flexible members 185. The rod-like flexible members 185 is attachable to and detachable from the key-side supporters 183 and the frame-side supporter 585. It is noted that the rod-like flexible members 185 may be integral with the key-side supporters 183 and the frame-side supporter 585 or bonded thereto so as not to be attached or detached, for example.

The key 100 includes a front-end key guide 151 and a side-surface key guide 153. The front-end key guide 151 is in slidable contact with a front-end frame guide 511 of the frame 500 in a state in which the front-end key guide 151 covers the front-end frame guide 511. The front-end key guide 151 is in contact with the front-end frame guide 511 at opposite side portions of upper and lower portions of the front-end key guide 151 in the scale direction. The side-surface key guide 153 is in slidable contact with a side-surface frame guide 513 at opposite side portions of the side-surface key guide 153 in the scale direction. In the present example, the side-surface key guide 153 is disposed at portions of side surfaces of the key 100 which correspond to the non-visible portion NV, and the side-surface key guide 153 is nearer to the front end of the key 100 than the connecting portion 180 (the plate-like flexible member 181), but the side-surface key guide 153 may be disposed at a region corresponding to the visible portion PV.

Each of the hammer assembly 200 is attached so as to be pivotable with respect to the frame 500. A bearing 220 of the hammer assembly 200 supports a shaft portion 520 of the frame 500, and the shaft portion 520 is in slidable contact with the bearing 220. A front end portion 210 of the hammer assembly 200 is located in an inner space of a hammer supporter 120 of the key 100 and in contact with the hammer supporter 120 slidably substantially in the front and rear direction. This sliding portion, i.e., portions of the front end portion 210 and the hammer supporter 120 which are in contact with each other, are located under the key 100 at the visible portion PV (located in front of a rear end of the key main body portion). It is noted that a configuration of portions of the shaft portion 520 and the bearing 220 which are connected to each other, (a configuration of a pivot mechanism) will be described later in detail.

The hammer assembly 200 is provided with a metal weight 230 disposed on a back side of a pivot axis. In a normal state (i.e., a state in which the key 100 is not pressed), the weight 230 is placed on a lower stopper 410, and the front end portion 210 of the hammer assembly 200 pushes the key 100 upward. When the key 100 is pressed, the weight 230 moves upward and comes into contact with an upper stopper 430. The hammer assembly 200 applies a weight to key pressing by the weight 230. The lower stopper 410 and the upper stopper 430 are formed of a cushioning material (such as a nonwoven fabric and a resilient material).

The sensor 300 is attached to the frame 500 under the hammer supporter 120 and the front end portion 210. When the key 100 is pressed, a lower surface of the front end portion 210 deforms the sensor 300, causing the sensor 300 to output detection signals. As described above, the sensors 300 are provided for the respective keys 100.

Configuration of Pivot Mechanism of Hammer Assembly

Figure 4:
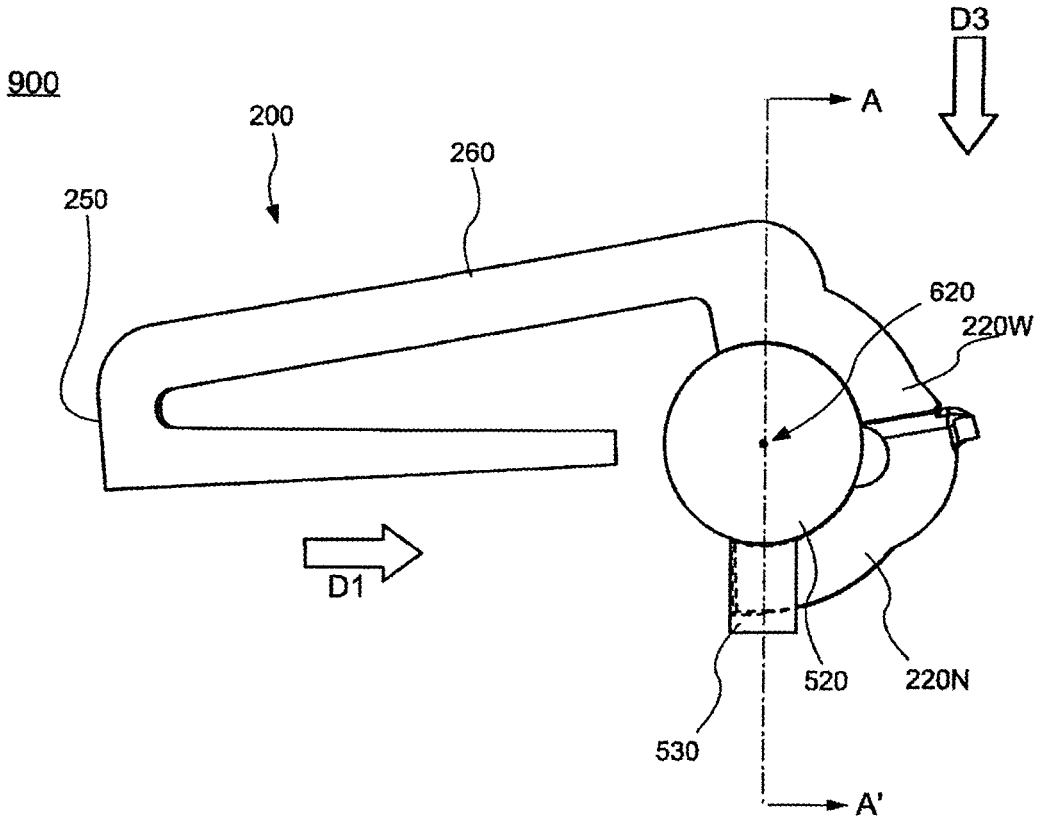
FIG. 4 is an enlarged view of portions of a bearing and a shaft portion of a hammer assembly in the one embodiment of the present disclosure.
Figure 5A:
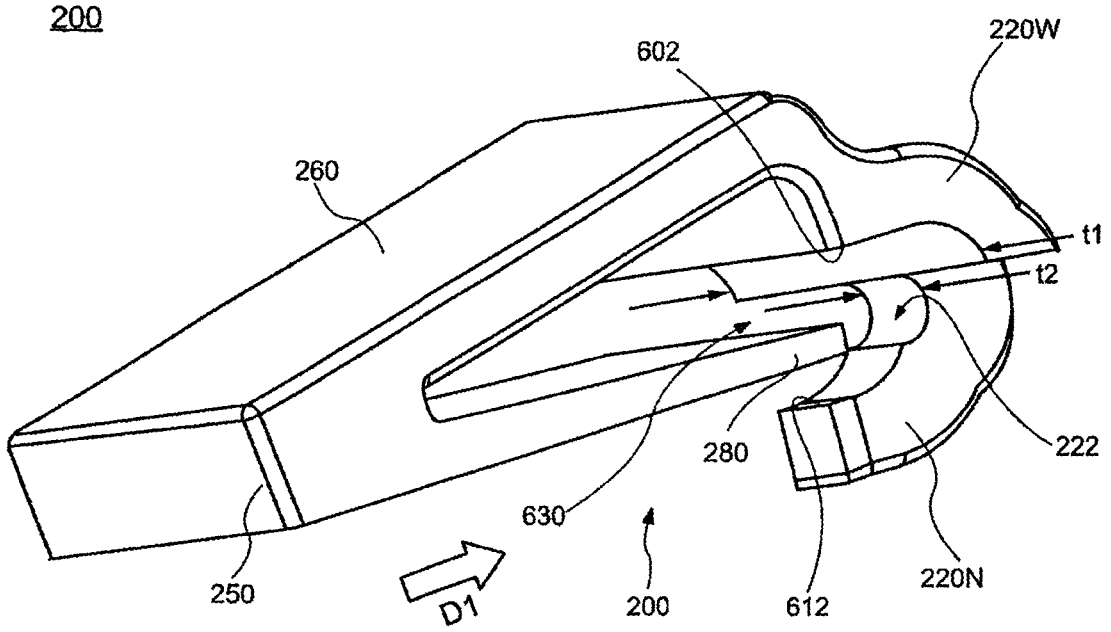
FIGS. 5A and 5B are enlarged views of portions of the bearing and the shaft portion of the hammer assembly in the one embodiment of the present disclosure.
Figure 5B:
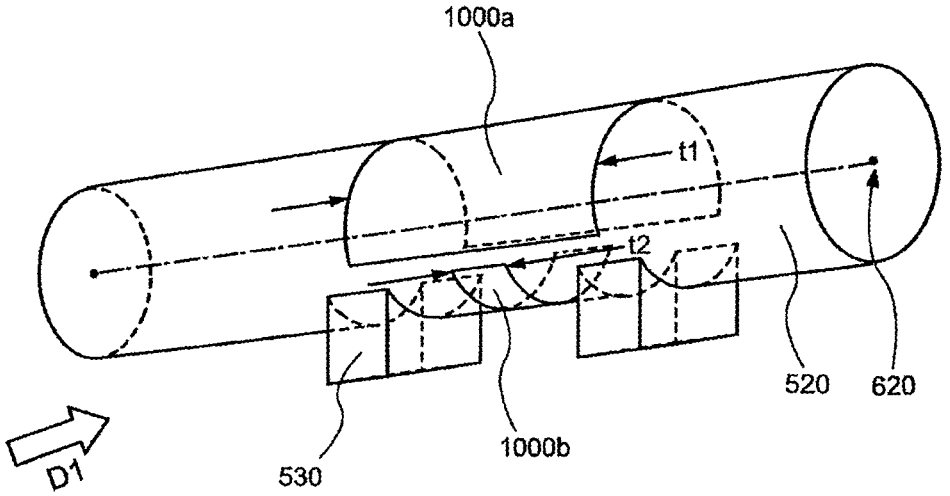

FIGS. 4 and 5 are enlarged views of portions of the bearing 220 and the shaft portion 520 of the hammer assembly 200 in the one embodiment of the present disclosure. FIG. 4 is a view illustrating a state in which the bearing 220 is mounted on the shaft portion 520 when viewed in the axial direction of the shaft portion 520. FIG. 5A is an exploded perspective view of only the bearing 220. FIG. 5B is an exploded perspective view of only the shaft portion 520. A pivot mechanism 900 includes: the shaft portion 520 serving as a pivot axis of the hammer assembly 200; and the bearing 220 configured to support the shaft portion 520. Here, the shaft portion 520 includes reinforcements 530. It is noted that configurations of the shaft portion 520 and the reinforcements 530 will be described later in detail. The hammer assembly 200 includes the bearing 220, a connecting portion 250, a body 260, and a shaft stopper 280. The bearing 220 includes a bearing 220W (a first receiver) and a bearing 220N (a second receiver) arranged in a direction in which the bearing 220 pivots about the shaft portion 520 (the pivotal direction). The bearing 220W and the bearing 220N respectively have different thicknesses in the axial direction of the pivot axis (the scale direction). While a configuration in which the bearing 220 pivots with respect to the fixed shaft portion 520 will be described in the following explanation, this pivotal movement may be expressed as movement of the shaft portion 520 with respect to the hammer assembly 200 (the bearing 220) for convenience of explanation. The embodiments described below may applied to a configuration in which the shaft portion 520 pivots with respect to the fixed bearing 220.

The bearing 220 pivots about the pivot axis 620. In the present example, the pivot axis 620 is located at the substantially center of the shaft portion 520. The bearing 220 has an opening 630. The shaft portion 520 is supported at a region inside the opening 630. Here, the cross-sectional shape of the opening 630 in the axial direction of the pivot axis (the scale direction) is an arc shape, and the cross-sectional shape of the shaft portion 520 in the axial direction of the pivot axis (the scale direction) is a round shape. The cross-sectional shapes of the opening 630 and the shaft portion 520 have substantially the same radius, and an inner circumferential surface of the opening 630 contacts an outer circumferential surface of the shaft portion 520. The width between open ends 602, 612 of the opening 630 is less than the diameter of the shaft portion 520. That is, the pivot mechanism 900 has a snap-fit configuration in which the shaft portion 520 and the bearing 220 are fitted to each other pivotably. In other words, the bearing 220 supports the shaft portion 520 by snap-fit. This prevents the shaft portion 520 from dropping off. Also, the bearing 220 can stably pivot about the pivot axis 620. However, the present disclosure is not limited to this configuration, and the pivot axis 620 of the bearing 220 may be displaced from the substantially center of the shaft portion 520.

However, the present disclosure is not limited to this configuration, and the pivot mechanism 900 may not have the snap-fit configuration of the shaft portion 520 and the bearing 220. For example, the radius of the cross-sectional shape of the opening 630 may be greater than that of the cross-sectional shape of the shaft portion 520, and the width between the open ends 602, 612 of the opening 630 may be greater than the diameter of the cross-sectional shape of the shaft portion 520. The cross-sectional shape of the shaft portion 520 may not be a round shape, and the cross-sectional shape of the opening 630 may not be an arc shape. For example, the cross-sectional shape of the shaft portion 520 may be any of a semicircular shape, a fan-like shape, a round shape having a recess, and a polygonal shape. In this case, the inner circumferential surface of the opening 630 may have a region at which the inner circumferential surface does not contact the outer circumferential surface of the shaft portion 520. In other words, the inner circumferential surface of the opening 630 and the outer circumferential surface of the shaft portion 520 at least need to temporarily contact each other at a region at which load is applied during pivotal movement. In a range of pivotal movement of the bearing 220 with respect to the shaft portion 520, the cross-sectional shape, in the scale direction, of the region at which the inner circumferential surface of the opening 630 contacts the outer circumferential surface of the shaft portion 520 is preferably a curved shape. The cross-sectional shape of the inner circumferential surface of the opening 630 and the outer circumferential surface of the shaft portion 520 preferably is an arc shape at the region at which load is applied during pivotal movement. The outer circumferential surface of the shaft portion 520 may be a portion of an arc centered about the pivot axis 620. Since the cross-sectional shape of each of the inner circumferential surface of the opening 630 and the outer circumferential surface of the shaft portion 520 at the region at which the inner circumferential surface of the opening 630 and the outer circumferential surface of the shaft portion 520 contact each other is a curved shape, the bearing 220 can be smoothly pivoted with respect to the shaft portion 520, resulting in reduced concentration of stress applied to the shaft portion 520, thereby improving the strength and the stiffness of the shaft portion 520.

The inner circumferential surface of the opening 630 may further have a groove 222. The bearing 220 does not contact the outer circumferential surface of the shaft portion 520 at the groove 222. The groove 222 is usable as grease storage. Furthermore, the groove 222 reduces the area of contact between the shaft portion 520 and the bearing 220, resulting in a reduced frictional force during pivotal movement of the shaft portion 520 and the bearing 220. However, the present disclosure is not limited to this configuration, and the groove 222 may be omitted.

The bearing 220 has flexibility. Bending of the bearing 220 increases the width between the open ends 602, 612. The bearing 220 may be bent so as to move only the open end 612 and may be bent so as to move both of the open ends 602, 612. Here, the direction of bending of the bearing 220 at its portion near the open end 612 is a direction of a normal line at a contact between the shaft portion 520 and the portion of the bearing 220 which is located near the open end 612.

The shaft stopper 280 is disposed at a position opposed to the opening 630 and spaced apart from the shaft portion 520. The shaft stopper 280 is fixed to the bearing 220 via the connecting portion 250 and the body 260. The connecting portion 250 is provided on an opposite side of the body 260 from the bearing 220. The connecting portion 250 extends downward from the body 260. The shaft stopper 280 is coupled to a lower end of the connecting portion 250 and extends from the connecting portion 250 toward the bearing 220. When the bearing 220 is about to be separated from the shaft portion 520, the shaft stopper 280 contacts the shaft portion 520, thereby preventing separation of the bearing 220 from the shaft portion 520.

The shaft stopper 280 may have flexibility so as to be bendable toward the body 260 and bendable toward and away from the body 260. The shaft stopper 280 is configured such that an amount of bending of the shaft stopper 280 is reduced in a direction in which the bearing 220 is separated from the shaft portion 520 (i.e., a direction directed from the shaft portion 520 toward the shaft stopper 280). That is, the shaft stopper 280 is configured such that, when the shaft portion 520 is relatively moved in the direction in which the shaft portion 520 is separated from the bearing 220, the amount of bending of the shaft stopper 280 is reduced in a direction of a normal line at a contact between the shaft stopper 280 and the shaft portion 520 (a direction in which the shaft stopper 280 is extended).

In FIG. 4, the shaft portion 520 includes the reinforcements 530 at the outer circumferential surface of the shaft portion 520. The reinforcements 530 protrude from the outer circumferential surface of the shaft portion 520 in a direction in which the shaft portion 520 receives load from the bearing 220. The reinforcements 530 are located on the outer circumferential surface of the shaft portion 520 in a range in the direction in which the shaft portion 520 receives load from the bearing 220, in the range of pivotal movement of the bearing 220 with respect to the shaft portion 520. Here, the direction in which the shaft portion 520 receives load from the bearing 220 is a direction in which the bearing 220 applies load to the shaft portion 520, and the direction changes in the range of pivotal movement of the bearing 220 with respect to the shaft portion 520.

In FIG. 5B, a region of the outer circumferential surface of the shaft portion 520 which is contactable by the bearing 220 will be referred to as "first region 1000". That is, in the range of pivotal movement of the bearing 220 with respect to the shaft portion 520, the first region 1000 is a region on the outer circumferential surface of the shaft portion 520, which region is constituted by: a region 1000*a* contactable by the bearing 220W with the width t1 in the pivot-axis direction; and a region 1000*b* contactable by the bearing 220N with the width t2 in the pivot-axis direction. Load related to the pivotal movement is applied to the first region 1000 of the shaft portion 520. A direction in which the bearing 220 applies the load to the shaft portion 520 is a direction normal to the first region (a direction toward the pivot axis 620). A region not including the first region in a region, on the outer circumferential surface of the shaft portion 520, which is opposed via the pivot axis 620 to the first region 1000 contactable by the bearing 220 in the range of pivotal movement of the bearing 220 with respect to the shaft portion 520 will be referred to as "second region". That is, the second region is a region of the outer circumferential surface of the shaft portion 520 which does not contact the bearing 220 and is opposed to the first region 1000 via the pivot axis 620 in the range of pivotal movement of the bearing 220 with respect to the shaft portion 520. In the present embodiment, the reinforcements 530 are located in the second region. Each of the reinforcements 530 is a protrusion connected to the outer circumferential surface of the shaft portion 520 and protruding to a position outside the shaft diameter of the shaft portion 520. Each of the reinforcements 530 extends from at least a portion of the second region to the outside of the bearing 220 in the pivot-axis direction. That is, a portion of the reinforcement 530 protrudes from the second region, and another portion of the reinforcement 530 protrudes from a region different from the second region which is located outside the bearing 220. The portion of the reinforcement 530 which protrudes from the second region and the portion of the reinforcement 530 which protrudes from the region located outside the bearing are continuous to each other. Since the reinforcement 530 is disposed at such a position, it is possible to improve the strength and the stiffness of the shaft portion 520, thereby increasing the durability of the pivot mechanism.

The direction in which the load is received includes: a direction of a force received from load applied due to the weight of a component such as the hammer assembly and the key in a state in which the key is released (the key is not pressed); and a direction of a force received from both of a force received from the front end portion 210 so as to depress the key and a reaction force applied to a rear end portion of the hammer assembly when movement of the rear end portion is stopped by the upper stopper 430 at full stroke during key pressing. In the middle of key pressing, an inertial force is applied due to a force applied to the front end portion 210 for pressing the key and the weight of a portion of the hammer assembly which is located near the weight 230. Thus, load is applied to the hammer assembly 200, thereby applying load to the shaft portion 520 via the bearing 220. In the present embodiment, as illustrated in FIG. 5A, the bearing 220 includes the bearing 220W (the first receiver) and the bearing 220N (the second receiver) arranged in a direction in which the bearing 220 pivots about the pivot axis 620 (the pivotal direction). The bearing 220W and the bearing 220N respectively have different thicknesses in the axial direction of the pivot axis (the scale direction). The thickness in the pivot-axis direction (the scale direction) is greater in the bearing 220W as the region (as one example of the first receiver) that applies particularly heavy load to the shaft portion 520 than in the bearing 220N as the other region (as one example of the second receiver). That is, the thickness t1 of the bearing 220W is greater than the thickness t2 of the bearing 220N. Since the thickness t1 of the bearing 220W as the region that applies heavy load to the shaft portion 520, it is possible to improve the strength and the stiffness of the bearing 220W, thereby increasing the durability of the pivot mechanism.

As illustrated in FIG. 5B, the bearing 220W and the bearing 220N contact the shaft portion 520 at different positions in the pivotal direction. That is, the bearing 220W and the bearing 220N contact the shaft portion 520 at different positions in the circumferential direction of the outer circumferential surface of the shaft portion 520. The bearing 220W contacts the region 1000*a* of the shaft portion 520 in the range of the width t1 in the pivot-axis direction, and the bearing 220N contacts the region 1000*b* of the shaft portion 520 in the range of the width t2 in the pivot-axis direction. Opposite ends of the bearing 220N are located between opposite ends of the bearing 220W in the pivot-axis direction. The region of the bearing 220W which is contactable with the outer circumferential surface of the shaft portion 520 in the range of pivotal movement of the bearing 220W with respect to the shaft portion 520 will be hereinafter referred to as "third region 1000*a*". That is, the third region 1000*a* is a portion of the first region 1000. Load related to the pivotal movement is applied to the third region 1000*a* of the shaft portion 520. A direction in which the bearing 220W applies the load to the shaft portion 520 is a direction normal to the third region 1000*a* (a direction toward the pivot axis 620). A region not including the first region 1000 in a region, on the outer circumferential surface of the shaft portion 520, which is opposed via the pivot axis 620 to the third region 1000*a* contactable by the bearing 220W in the range of pivotal movement of the bearing 220W with respect to the shaft portion 520 will be referred to as "fourth region". That is, the fourth region is a portion of the second region. In the present embodiment, the reinforcements 530 are located at the fourth region. Each of the reinforcements 530 extends from at least a portion of the fourth region to the outside of the bearing 220W in the pivot-axis direction. The arrangement of the reinforcements 530 at these positions further improves the strength and the stiffness of the shaft portion 520, thereby further increasing the durability of the pivot mechanism. For example, in FIG. 4, the shaft portion 520 receives load from the bearing 220W in the up and down direction on the sheet of the drawing (a D3 direction). The D3 direction may be hereinafter referred to as "load direction". The reinforcements 530 protrude in the D3 direction from the outer circumferential surface of the shaft portion 520.

Figure 6A:
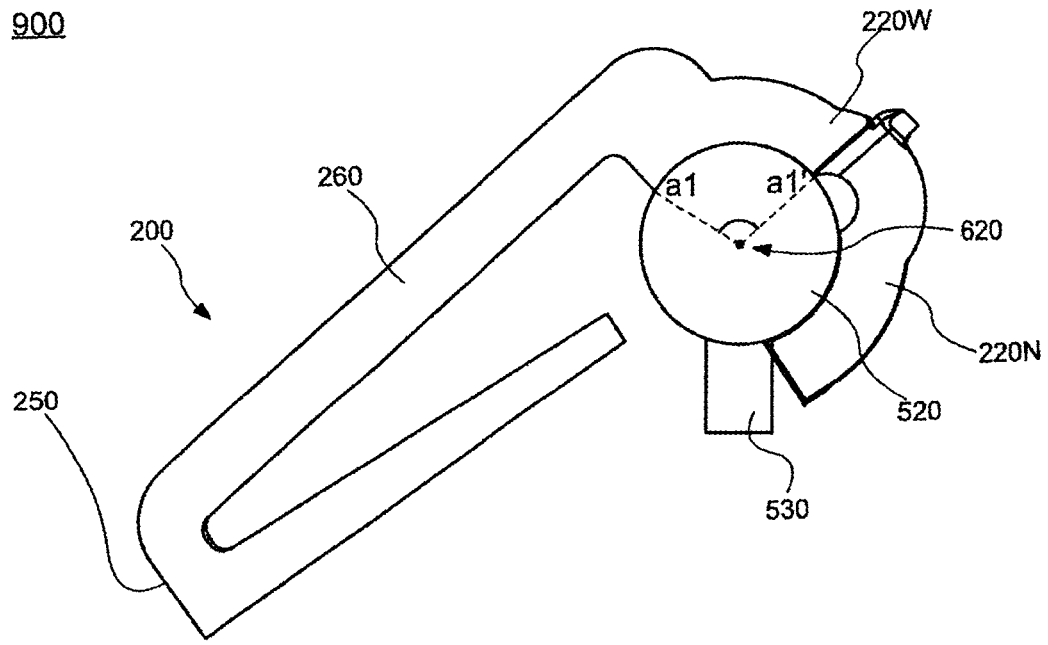
FIGS. 6A and 6B are enlarged views of portions of the bearing and the shaft portion of the hammer assembly in the one embodiment of the present disclosure.
Figure 6B:
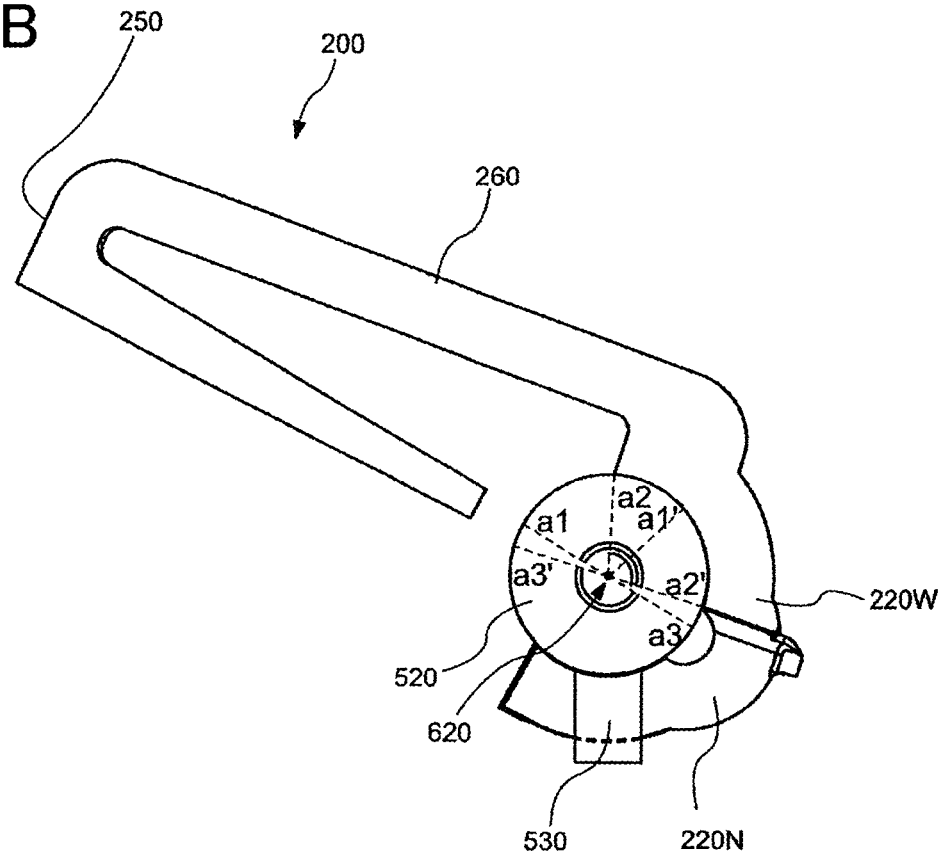

The bearing 220 pivots with respect to the shaft portion 520 in response to pressing or releasing of the key. Movement of the bearing 220W with respect to the shaft portion 520 in response to pressing or releasing of the key, and a range of load applied to the shaft portion 520 will be explained with reference to FIGS. 6A and 6B. FIGS. 6A and 6B are enlarged views of portions of the bearing 220 and the shaft portion 520 of the hammer assembly 200 in the one embodiment of the present disclosure. FIG. 6A illustrates a positional relationship between the bearing 220 located at a rest position and the shaft portion 520. A region of the bearing 220W which contacts the shaft portion 520 at the rest position (in the state in which the key is released and not pressed) extends between a1 and a1'. In response to key pressing, the region of the bearing 220W which contacts the shaft portion 520 (as one example of a fifth region) changes in the clockwise direction from between a1 and a1' to between a2 and a2'. FIG. 6B indicates a positional relationship between the bearing 220 located at an end position and the shaft portion 520. At the end position (in a state in which the key is fully depressed), the region of the bearing 220W which contacts the shaft portion 520 extends between a2 and a2'. In response to releasing of the key, the region of the bearing 220W which contacts the shaft portion 520 changes in the counterclockwise direction from between a1 and a1' to between a2 and a2'. That is, the third region of the bearing 220W which is contactable with the shaft portion 520 in the range of pivotal movement of the bearing 220W with respect to the shaft portion 520 extends between a1 and a2'. Load related to the pivotal movement is applied to the third region of the shaft portion 520. A direction in which the bearing 220W applies the load to the shaft portion 520 is a direction normal to the third region (a direction toward the pivot axis 620). The reinforcements 530 may protrude in the fourth region that does not contact the bearing 220W in the region a3-a3' opposed via the pivot axis 620 to the third region a1-a2' of the bearing 220W which is contactable with the shaft portion 520.

Figure 7A:
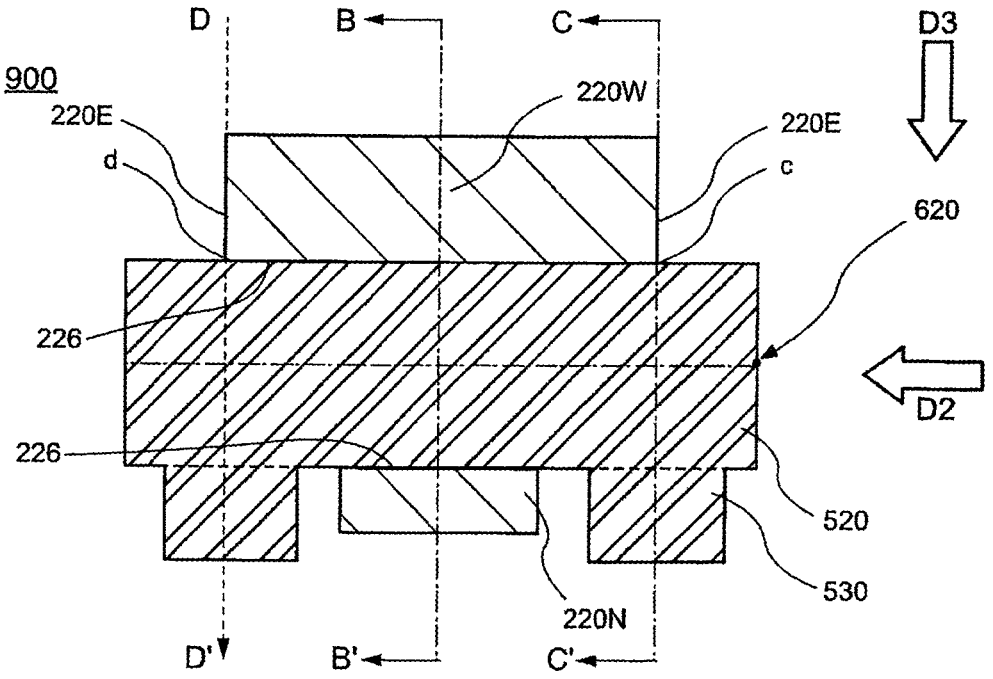
FIGS. 7A through 7C are cross-sectional views of a pivot mechanism in one embodiment of the present disclosure.
Figure 7B:
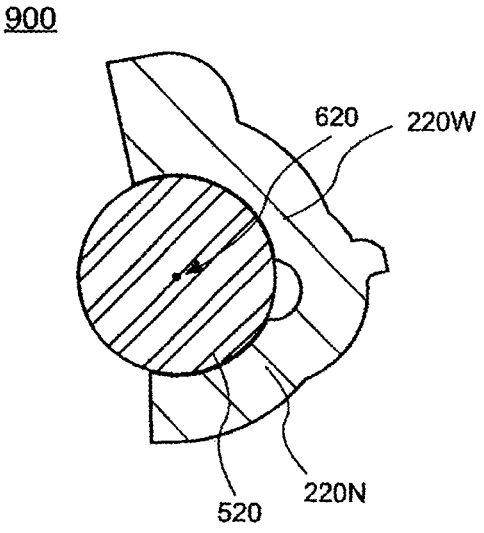
Figure 7C:
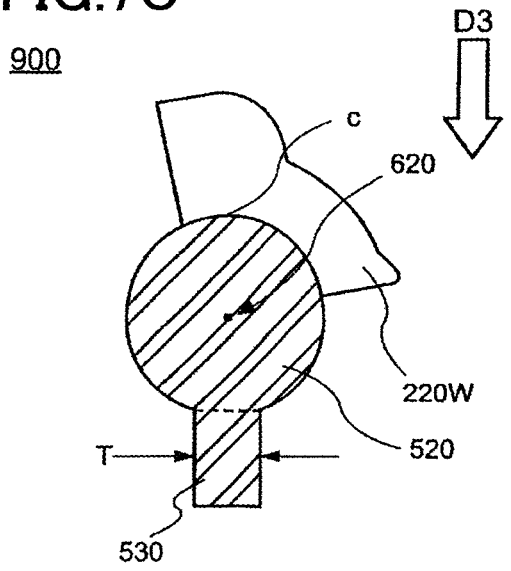

FIGS. 7A and 7B are cross-sectional views of the pivot mechanism in the one embodiment of the present disclosure. FIG. 7A is a cross-sectional view taken along line A-A in FIG. 4(A) when viewed in a D1 direction. FIG. 7B is a cross-sectional view taken along line B-B' in FIG. 7A when viewed in the same direction as in FIGS. 3 and 4 (a D2 direction). FIG. 7C is a cross-sectional view taken along line C-C in FIG. 7A when viewed in the same direction as in FIGS. 3 and 4 (the D2 direction). FIG. 7 illustrates the shaft portion 520 and the bearing 220. The bearing 220 supports a contact surface 226 of the shaft portion 520. In other words, the shaft portion 520 contacts the bearing 220 at the contact surface 226. The opposite ends of the bearing 220N are located between opposite ends of the bearing 220W in the pivot-axis direction.

In FIG. 7A, the shaft portion 520 includes the reinforcements 530 protruding on a side nearer to the bearing 220N having the smaller width, so as to support the outer circumferential surface of the shaft portion 520 at least at the opposite ends of the bearing 220W having the larger width. That is, the shaft portion 520 includes the reinforcements 530 protruding in the direction in which load is applied from the bearing 220. The reinforcements 530 protrude in the load direction (the D3 direction) respectively from boundaries c, d, in the axial direction, of a region of the shaft portion 520 which receives load, in the range of pivotal movement of the bearing 220W with respect to the shaft portion 520. In other words, in the range of pivotal movement of the bearing 220W with respect to the shaft portion 520, each of the reinforcements 530 extends in the axial direction to the outside of the bearing 220W from a corresponding one of portions of the region (the fourth region between c and d on the side nearer to the bearing 220N) not including the region contacted by the bearing 220 in the region opposed via the pivot axis 620 to the region in which the inner circumferential surface of the opening 630 of the bearing 220W applies load to the contact surface 226 (the third region 1000*a* between c and d on the side nearer to the bearing 220W). Each of the reinforcements 530 is a protrusion connected to the outer circumferential surface of the shaft portion 520 and protruding to a position outside the shaft diameter of the shaft portion 520.

In FIG. 7A, for example, the shaft portion 520 receives load from the bearing 220 in the up and down direction on the sheet of the drawing (the D3 direction). The shaft portion 520 receives particularly heavy stress from the opposite end portions 220E of the bearing 220W having the larger width, at the boundaries c, d of the load-receiving region in the axial direction. The reinforcements 530 protrude in the D3 direction from the outer circumferential surface of the shaft portion 520 which is contacted by the bearing 220N. Here, planes each orthogonal to the D2 direction and respectively containing the boundaries c, d of the load-receiving region in the axial direction are defined as imaginary planes. In this example, the opposite end portions 220E of the bearing 220W having the larger width are located respectively on planes orthogonal to the D2 direction. Thus, the opposite end portions 220E of the bearing 220W having the larger width are located on the respective imaginary planes. The reinforcements 530 are connected to the shaft portion 520 at positions on the respective imaginary planes. The reinforcements 530 are provided respectively at positions intersecting the respective imaginary planes. That is, the reinforcements 530 protrude at the positions containing the respectively imaginary planes that are perpendicular to the pivot axis and contain the respective opposite end portions 220E of the bearing 220W having the larger width, whereby the reinforcements 530 deal with the above-described heavy stress. In the case where the plane containing the boundary c and orthogonal to the D2 direction is defined as an imaginary plane c, and the plane containing the boundary d and orthogonal to the D2 direction as an imaginary plane d, each of the reinforcements 530 includes: an inner portion interposed between the imaginary plane c and the imaginary plane d; and an outer portion not interposed between the imaginary plane c and the imaginary plane d, and the inner portion and the outer portion are continuous to each other. A portion of the reinforcement 530 protrudes from the outer circumferential surface of the shaft portion 520 at its inner region that is interposed in the D2 direction between the left end portion 220E (as one example of a first end portion) and the right end portion 220E (as one example of a second end portion). A portion of the reinforcement 530 protrudes from the outer circumferential surface of the shaft portion 520 at its outer region that is not interposed in the D2 direction between the left end portion 220E and the right end portion 220E. The reinforcement 530 is configured such that the portion protruding from the inner region and the portion protruding from the outer region are continuous to each other. In FIG. 7A, it is possible to consider that the boundaries c, d are boundaries in the D2 direction for the region in which the outer circumferential surface of the shaft portion 520 contacts the bearing 220. In this case, the position of the boundary c in the D2 direction is located between a left end portion (as one example of a first end) and a right end portion (as one example of a second end) of the right reinforcement 530 in the D2 direction. Likewise, the position of the boundary d in the D2 direction is located between a left end portion (as one example of the first end) and a right end portion (as one example of the second end) of the left reinforcement 530 in the D2 direction. That is, when viewed in the direction orthogonal to the D2 direction as in FIG. 7A, the reinforcements 530 are provided on the shaft portion 520 such that each of the positions of the respective boundaries c, d in the D2 direction is located between the left end portion and the right end portion of a corresponding one of the reinforcements 530.

FIG. 7B is a view illustrating the cross section taken along line B-B' in the axial direction at a central portion of the bearing 220. The bearing 220 supports the shaft portion 520 so as to position the shaft portion 520 to a region inside the opening 630. The inner circumferential surface of the opening 630 of the bearing 220 (the bearing 220W and the bearing 220N) contacts the outer circumferential surface of the shaft portion 520 at a broader region (a greater range of an angle viewed from the center of the shaft) at the central portion of the bearing 220 in the axial direction than at the axial end portion 220E of the bearing 220. FIG. 7C is a view illustrating the cross section taken along line C-C' in the axial direction at an end portion of the bearing 220. At each of the axial end portions 220E of the bearing 220W, the inner circumferential surface of the opening 630 of the bearing 220 (the bearing 220W) contacts the shaft portion 520 mainly at the region that applies load to the shaft portion 520. The reinforcements 530 connected to the shaft portion 520 are located at the respective regions opposed via the pivot axis 620 to the region in which the shaft portion 520 receives load from the bearing 220. This configuration enables arrangement of the reinforcements 530 on the shaft portion 520 without interfering with pivotal movement of the bearing 220 relative to the shaft portion 520. The reinforcement 530 extending in the load direction (the D3 direction) can be disposed on the shaft portion 520 at the boundary c of the region that receives particularly heavy stress from the bearing 220.

In FIG. 7A, the reinforcements 530 are provided so as to protrude in the load direction (the D3 direction) respectively from the boundaries c, d of the region in which the bearing 220 applies load to the shaft portion 520. However, the present disclosure is not limited to this configuration, and the number of the reinforcements 530 may be any number as long as pivotal movement of the bearing 220 relative to the shaft portion 520 is not interfered. The shape of each of the reinforcements 530 may be symmetric with respect to the center (B-B') in the axial direction. In FIGS. 4-7, the shape of each of the reinforcements 530 is shaped like a rectangular flat plate. However, the present disclosure is not limited to this configuration, and each of the reinforcements 530 may have any shape as long as pivotal movement of the bearing 220 relative to the shaft portion 520 is not interfered, and the reinforcement 530 is connected to the shaft portion 520 stably. For example, the reinforcement 530 may be shaped like a polygonal or arc flat plate and may be shaped like any of a polygonal cylinder, a circular cylinder, and a ball, for example. As illustrated in FIG. 7C, the reinforcement 530 has a thickness T that is about one third of the diameter of the shaft portion 520. However, this thickness may be a desired thickness.

In the pivot mechanism 900 according to the present embodiment as described above, the above-described reinforcements 530 improve the strength and the stiffness of the shaft portion 520, thereby increasing the durability of the pivot mechanism.

Operations of Keyboard Assembly

Figure 8A:
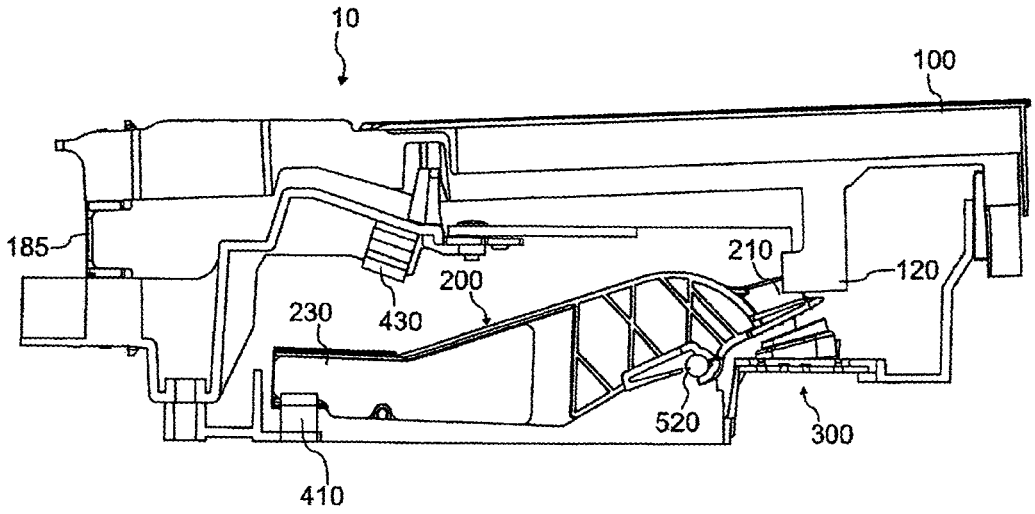
FIGS. 8A and 8B are views for explaining operations of a keyboard assembly when a key (a white key) is depressed in the one embodiment of the present disclosure.
Figure 8B:
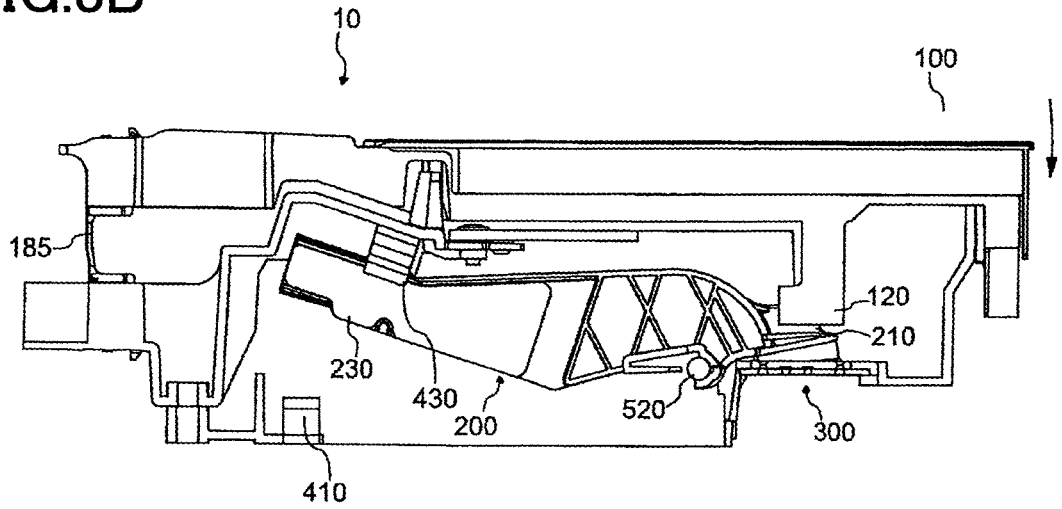

FIGS. 8A and 8B are views for explaining operations of the key assembly when the key (the white key) is depressed in the one embodiment of the present disclosure. FIG. 8A is a view illustrating a state in which the key 100 is located at a rest position (that is, the key is not depressed). FIG. 8B is a view illustrating a state in which the key 100 is located at an end position (that is, the key is fully depressed). When the key 100 is pressed, the rod-like flexible member 185 is bent as a pivot center. In this state, though the rod-like flexible member 185 is bent toward the front side of the key (in the front direction), the side-surface key guide 153 inhibits the key 100 from moving in the front and rear direction, and thereby the key 100 pivots instead of moving frontward. The hammer supporter 120 depresses the front end portion 210, causing pivotal movement of the hammer assembly 200 about the shaft portion 520. When the weight 230 collides with the upper stopper 430, the pivotal movement of the hammer assembly 200 is stopped, and the key 100 reaches the end position. When the sensor 300 is deformed by the front end portion 210, the sensor 300 outputs the detection signals in accordance with a plurality of levels of an amount of deformation of the sensor 300 (i.e., the key pressing amount).

When the key is released, the weight 230 moves downward, the hammer assembly 200 pivots, and the key 100 pivots upward. When the weight 230 comes into contact with the lower stopper 410, the pivotal movement of the hammer assembly 200 is stopped, and the key 100 is returned to the rest position. In the keyboard apparatus 1 according to the present embodiment, as described above, the key 100 pivots at the connecting portion 180 in response to key pressing and key releasing.

Second Embodiment

Figure 9A:
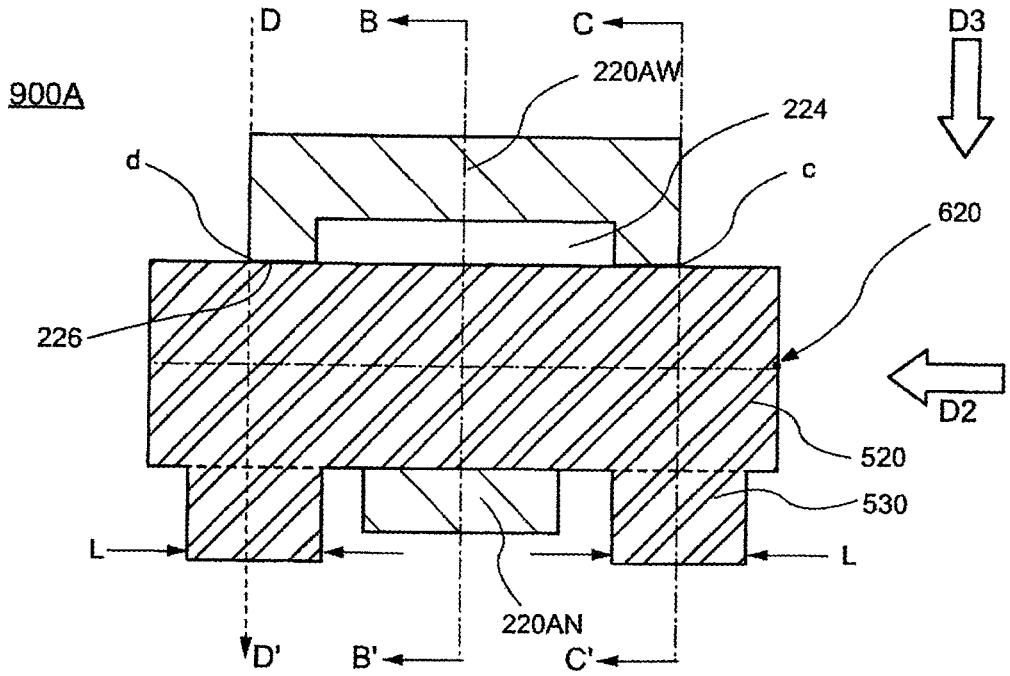
FIGS. 9A through 9C are cross-sectional views of a pivot mechanism in one embodiment of the present disclosure.
Figure 9B:
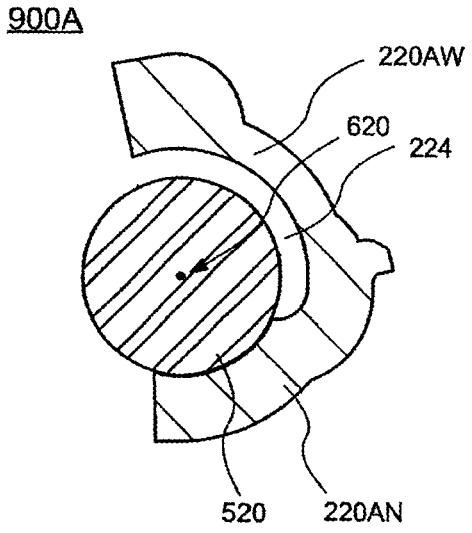
Figure 9C:
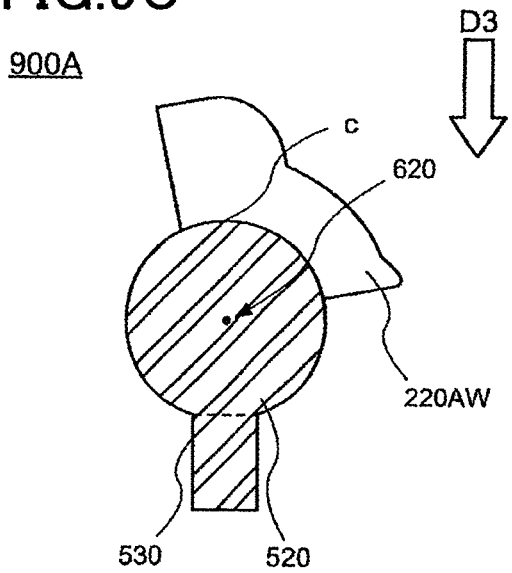

There will be described a pivot mechanism 900A according to a second embodiment which is different in configuration from the pivot mechanism 900 according to the first embodiment. FIGS. 9A through 9C are cross-sectional views of the pivot mechanism according to one embodiment of the present disclosure. The shape of a bearing 220A in the pivot mechanism 900A according to the second embodiment is different from that of the bearing 220 in the first embodiment. It is noted that the same reference numerals as used in the first embodiment are used to designate the corresponding elements of the second embodiment, and an explanation of which is dispensed with.

FIGS. 9A through 9C are cross-sectional views of the pivot mechanism according to the one embodiment of the present disclosure. FIG. 9A is a cross-sectional view of the pivot mechanism 900A according to the present embodiment which is viewed in the longitudinal direction of the key. FIG. 9B is a cross-sectional view taken along line B-B' in FIG. 9A and viewed in the D2 direction. FIG. 9C is a cross-sectional view taken along line C-C' in FIG. 9A and viewed in the D2 direction. FIG. 9 illustrates the shaft portion 520 and the bearing 220A.

In FIG. 9A, a bearing 220AW has a recess 224. The recess 224 is located at the inner circumferential surface of the opening 630 of the bearing 220AW. In other words, the bearing 220AW has the recess 224 in the surface for supporting the shaft portion 520. At the recess 224, the bearing 220AW does not contact the outer circumferential surface of the shaft portion 520. Thus, the recess 224 of the bearing 220AW reduces an area of contact between the shaft portion 520 and the bearing 220A, thereby reducing a friction when the bearing 220A pivots relative to the shaft portion 520. Since the bearing 220A has the recess 224, a region in which load is mainly applied from the bearing 220AW to the shaft portion 520 concentrates on opposite end portions 226 of the bearing which contact the shaft portion 520. The position of the recess 224 is not limited to this configuration, the recess 224 may also be formed at a portion of the contact surface 226 which is nearer to a bearing 220AN opposed via the shaft portion 520.

In FIG. 9A, the recess 224 is located at the center of the bearing 220AW in the axial direction. Thus, the contact surfaces 226 of the shaft portion 520 which are contacted by the inner circumferential surface of the opening 630 of the bearing 220AW are located respectively on opposite end portions of the bearing 220AW in the axial direction. In other words, the bearing 220AW contacts the shaft portion 520 at at least different two points in the axial direction. Thus, even a small area of contact between the bearing 220AW and the shaft portion 520 enables stable pivotal movement of the bearing 220AW with inhibition of movement of the bearing 220AW in the yawing direction and the rolling direction. However, the present disclosure is not limited to this configuration, and the number, the shape, and the position of the recess 224 are not limited as long as pivotal movement of the bearing 220A relative to the shaft portion 520 is not interfered.

In FIG. 9A, the shaft portion 520 includes the reinforcements 530 protruding on a side nearer to the bearing 220N having a smaller width, so as to support the outer circumferential surface of the shaft portion 520 at least at opposite ends of the bearing 220AW having a larger width. That is, the shaft portion 520 includes the reinforcements 530 protruding in the direction in which load is applied from the bearing 220A. The reinforcements 530 protrude in the load direction (the D3 direction) respectively from the outer boundaries c, d of the bearing 220AW in the axial direction in a region of the shaft portion 520 which receives load, in the range of pivotal movement of the bearing 220AW with respect to the shaft portion 520. In other words, in the range of pivotal movement of the bearing 220AW with respect to the shaft portion 520, each of the reinforcements 530 extends in the axial direction to the outside of the bearing 220AW from a corresponding one of portions of the region (the fourth region on the side nearer to the bearing 220N) not including the region contacted by the bearing 220A in the region opposed via the pivot axis 620 to the region in which the inner circumferential surface of the opening 630 of the bearing 220AW applies load to the contact surface 226 (the third region of the contact surface 226 between c and d on the side nearer to the bearing 220W). Each of the reinforcements 530 is a protrusion connected to the outer circumferential surface of the shaft portion 520 and protruding to the outside of the shaft diameter, with a length L included in the region of the contact surface 226 of the shaft portion 520 in the axial direction.

In FIG. 9A, for example, the shaft portion 520 receives load from the bearing 220A in the up and down direction on the sheet of the drawing (the D3 direction). The shaft portion 520 receives particularly heavy stress at the outer boundaries c, d, in the axial direction, of the region that receives load from the bearing 220AW. The reinforcements 530 may protrude in the D3 direction from the outer circumferential surface of the shaft portion 520 which is contacted by the bearing 220AN.

FIG. 9B is a view illustrating the cross section taken along line B-B' in the axial direction at a central portion of the bearing 220A. The bearing 220A supports the shaft portion 520 so as to position the shaft portion 520 to a region inside the opening 630. The recess 224 is located at the central portion of the bearing 220A in the axial direction in the inner circumferential surface of the opening 630 of the bearing 220AW. Thus, a central portion of the bearing 220AW in the axial direction does not contact the shaft portion 520. FIG. 9C is a view illustrating the cross section taken along line C-C' in the axial direction at an end portion of the bearing 220A. At each of the axial end portions (near C and near D) of the bearing 220AW, the inner circumferential surface of the opening 630 of the bearing 220A (the bearing 220AW) contacts the shaft portion 520 mainly at the region that applies load to the shaft portion 520. The reinforcements 530 connected to the shaft portion 520 are located at the respective regions opposed via the pivot axis 620 to the region in which the shaft portion 520 receives load from the bearing 220AW. This configuration enables arrangement of the reinforcements 530 on the shaft portion 520 without interfering with pivotal movement of the bearing 220A relative to the shaft portion 520. The reinforcement 530 extending in the load direction (the D3 direction) can be disposed on the shaft portion 520 at the boundary c of the region that receives particularly heavy stress from the bearing 220AW.

In FIG. 9A, the reinforcements 530 are provided so as to protrude in the load direction (the D3 direction) respectively from the boundaries c, d of the region in which the bearing 220A applies load to the shaft portion 520. However, the present disclosure is not limited to this configuration, and the number, the shapes, the thicknesses, and the positions of the reinforcements 530 are not limited as long as pivotal movement of the bearing 220A relative to the shaft portion 520 is not interfered.

In the pivot mechanism 900A according to the present embodiment, as described above, the bearing 220A supports the shaft portion 520 at at least different two points in the direction D2 in which the shaft portion 520 is extended, making it possible to inhibit movement of the bearing 220A in the yawing direction and the rolling direction. Since the bearing 220A has the recess 224, the area of contact between the bearing 220A and the shaft portion 520 is reduced, resulting in a reduced frictional force in pivotal movement of the shaft portion 520 and the bearing 220A. The reinforcements 530 improve the strength and the stiffness of the shaft portion 520, thereby increasing the durability of the pivot mechanism.

Third Embodiment

Figure 10A:
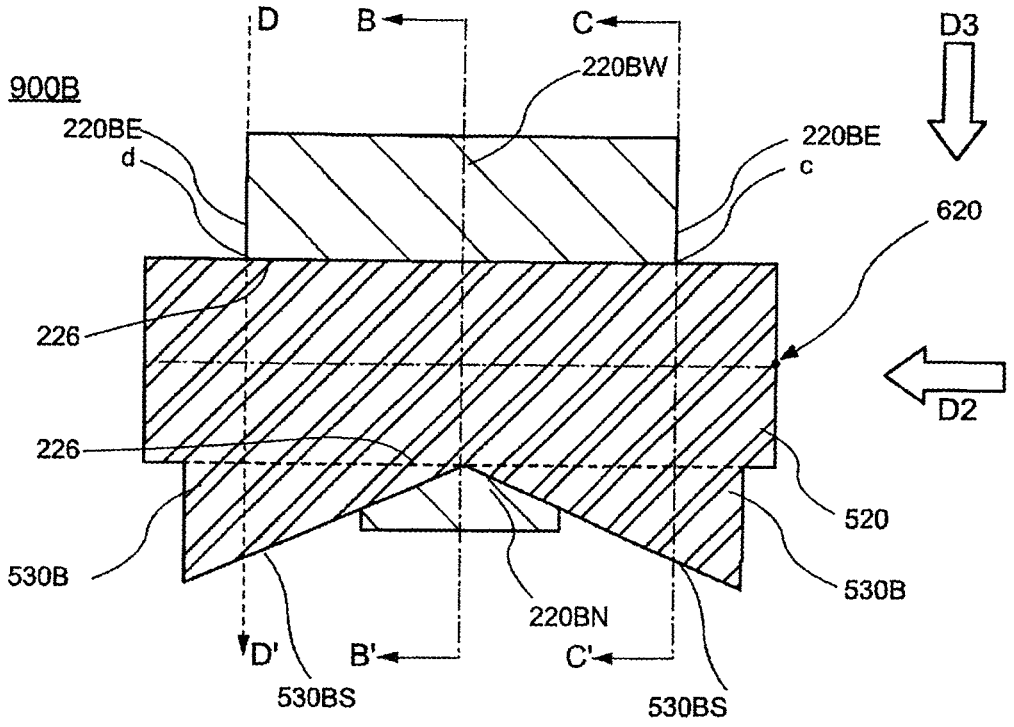
FIGS. 10A through 10C are cross-sectional views of a pivot mechanism in one embodiment of the present disclosure.
Figure 10B:
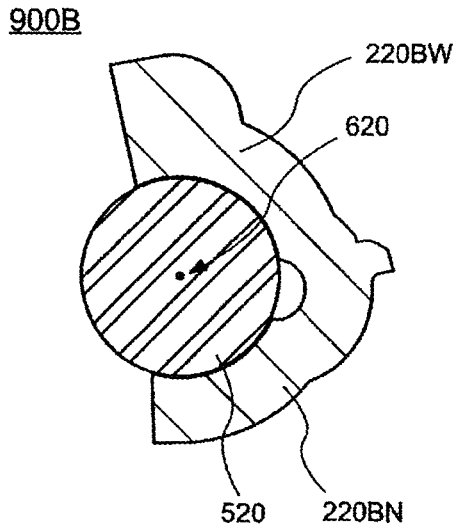
Figure 10C:
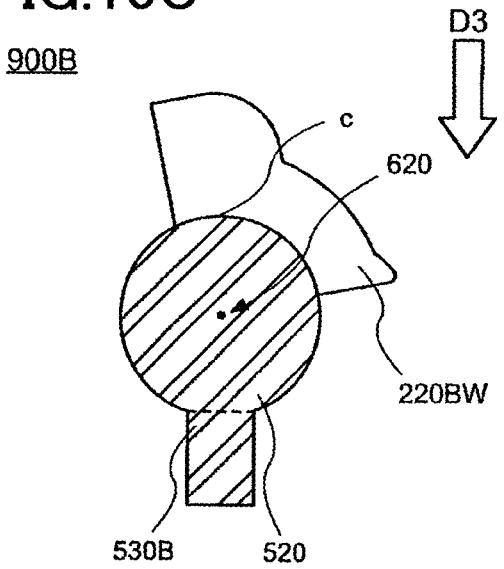

There will be described a pivot mechanism 900B according to a third embodiment which is different in configuration from the pivot mechanism 900 according to the first embodiment. FIGS. 10A through 10C are cross-sectional views of the pivot mechanism according to the one embodiment of the present disclosure. The shape of reinforcements 530B in the pivot mechanism 900B according to the third embodiment is different from that of the reinforcements 530 in the first embodiment. It is noted that the same reference numerals as used in the first embodiment are used to designate the corresponding elements of the third embodiment, and an explanation of which is dispensed with.

FIGS. 10A through 10C are cross-sectional views of the pivot mechanism according to the one embodiment of the present disclosure. FIG. 10A is a cross-sectional view of the pivot mechanism 900B according to the present embodiment which is viewed in the longitudinal direction of the key. FIG. 10B is a cross-sectional view taken along line B-B' in FIG. 10A and viewed in the D2 direction. FIG. 10C is a cross-sectional view taken along line C-C' in FIG. 10A and viewed in the D2 direction. FIGS. 10A through 10C illustrate the shaft portion 520 and a bearing 220B.

In FIG. 10A, the shaft portion 520 includes the reinforcements 530B protruding on a side nearer to a bearing 220BN having a smaller width, so as to support the outer circumferential surface of the shaft portion 520 at least at opposite ends of a bearing 220BW having a larger width. That is, the shaft portion 520 includes the reinforcements 530B protruding in the direction in which load is applied from the bearing 220B. The reinforcements 530B protrude in the load direction (the D3 direction) from a region of the shaft portion 520 which receives load and from boundaries c, d of the region in the axial direction, in the range of pivotal movement of the bearing 220BW with respect to the shaft portion 520. In other words, in the range of pivotal movement of the bearing 220BW with respect to the shaft portion 520, each of the reinforcements 530B extends in the axial direction over a region (a fourth region between c and d on the side nearer to the bearing 220N) not including a region contacted by the bearing 220B in a region opposed via the pivot axis 620 to a region in which the inner circumferential surface of the opening of the bearing 220BW applies load to the contact surface 226 (the third region between c and d on the side nearer to the bearing 220BW) and extends from the fourth region to the outside of the bearing 220BW in the axial direction. Each of the reinforcements 530B is a protrusion connected to the outer circumferential surface of the shaft portion 520 and protruding to a position outside the shaft diameter of the shaft portion 520.

In FIG. 10A, for example, the shaft portion 520 receives load from the bearing 220B in the up and down direction on the sheet of the drawing (the D3 direction). The shaft portion 520 receives particularly heavy stress from opposite end portions 220BE of the bearing 220BW having the larger width, at the boundaries c, d of the load-receiving region in the axial direction. The reinforcements 530B may protrude in the D3 direction from the outer circumferential surface of the shaft portion 520 which is contacted by the bearing 220BN. Each of the reinforcements 530B has a protruding amount that gradually increases with increase in distance from the center of the shaft portion 520 in the axial direction. That is, an inclined surface 530BS is formed so as to contact the bearing 220BN having the smaller width. The bearing 220BN having the smaller width protrudes most at its central portion, and the thickness of the bearing 220BN decreases with increase in distance from the central portion in the axial direction, the bearing 220BN has a surface that matches the inclined surface 530BS.

The reinforcements 530B do not exist at the center (B-B') in the axial direction on the outer circumferential surface nearer to the bearing 220BN. In this example, the pivot axis 620 of the bearing 220B is located at the substantially center of the shaft portion 520. This configuration of the reinforcements 530B can position the bearing 220B in the axial direction. However, the present disclosure is not limited to this configuration, and the number, the shapes, the thicknesses, and the positions of the reinforcements 530B are not limited as long as pivotal movement of the bearing 220B relative to the shaft portion 520 is not interfered. The pivot axis 620 of the bearing 220B may be displaced from the substantially center of the shaft portion 520.

FIG. 10B is a view illustrating the cross section taken along line B-B' in the axial direction at a central portion of the bearing 220B. The bearing 220B supports the shaft portion 520 so as to position the shaft portion 520 to a region inside the opening 630. The inner circumferential surface of the opening 630 of the bearing 220B (the bearing 220BW and the bearing 220BN) contacts the outer circumferential surface of the shaft portion 520 at a broader region (a greater range of an angle viewed from the center of the shaft) at the central portion of the bearing 220B in the axial direction than at the axial end portions 220BE of the bearing 220. As illustrated in FIG. 10A, the bearing 220BN may contact the inclined surfaces 530BS of the respective reinforcements 530B. That is, in the range of the pivotal movement of the bearing 220B relative to the reinforcements 530B, the thickness of the bearing 220BN decreases with increase in distance from the center (B') in the axial direction toward the axial end portion (C' or D'). In other words, in the range of the pivotal movement of the bearing 220B relative to the reinforcements 530B, the size of the opening of the bearing 220B increases with increase in distance from the center (B') in the axial direction toward the axial end portion (C' or D'). FIG. 10C is a view illustrating the cross section taken along line C-C' in the axial direction at an end portion of the bearing 220B. At each of the axial end portions 220BE of the bearing 220BW, the inner circumferential surface of the opening 630 of the bearing 220B (the bearing 220BW) contacts the shaft portion 520 mainly at the region that applies load to the shaft portion 520. The reinforcements 530 connected to the shaft portion 520 are located at the respective regions opposed via the pivot axis 620 to the region in which the shaft portion 520 receives load from the bearing 220B. This configuration enables arrangement of the reinforcements 530B on the shaft portion 520 without interfering with pivotal movement of the bearing 220B relative to the shaft portion 520. The reinforcement 530B extending in the load direction (the D3 direction) can be disposed on the shaft portion 520 at the boundary c of the region that receives particularly heavy stress from the bearing 220BW.

Figure 11:
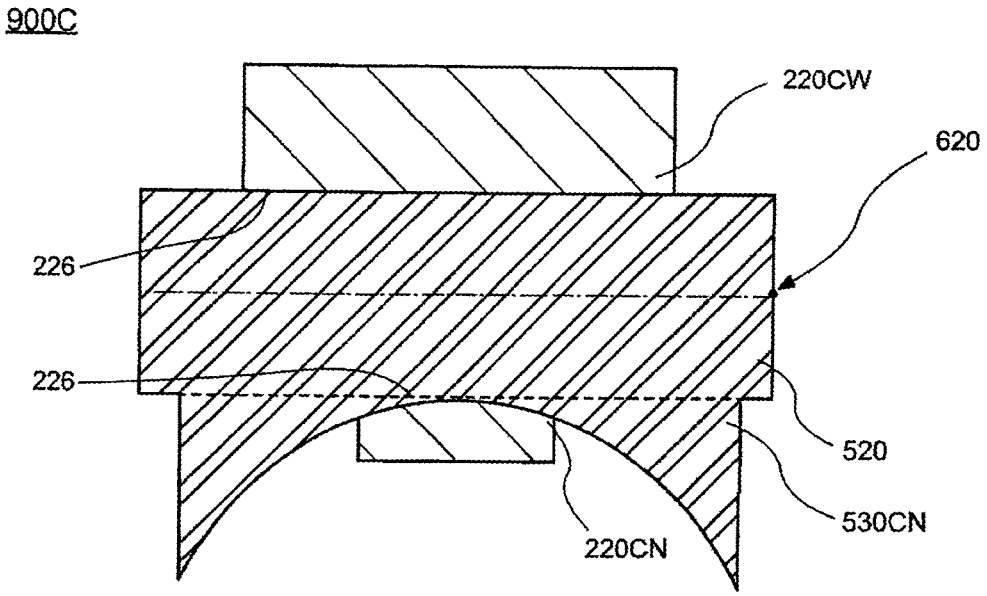
FIG. 11 is a cross-sectional view of a pivot mechanism in one embodiment of the present disclosure.

In FIG. 10A, the reinforcements 530B are provided so as to protrude in the load direction (the D3 direction) from the region in which the bearing 220B applies load to the shaft portion 520 and from the boundaries c, d of the region. However, the present disclosure is not limited to this configuration, and the number, the shapes, and the positions of the reinforcements 530B are not limited as long as pivotal movement of the bearing 220B relative to the shaft portion 520 is not interfered. The shape of each of the reinforcements 530B may be symmetric with respect to the center (B-B') in the axial direction. In FIG. 10A, each of the reinforcements 530B is shaped like a triangle flat plate that protrudes by a greater amount at an axial end portion of the bearing 220B than at its central portion in the axial direction. However, the present disclosure is not limited to this configuration, and each of the reinforcements 530B may have any shape as long as pivotal movement of the bearing 220B relative to the shaft portion 520 is not interfered, and the reinforcement 530B is connected to the shaft portion 520 stably. As illustrated in FIG. 11, for example, each of reinforcements 530C may be shaped like an arc flat plate. In this case, a bearing 220CN may have an arc surface. Each of the reinforcements 530 may be shaped like any of a polygonal cylinder, a circular cylinder, and a ball, for example.

In the pivot mechanism 900B according to the present embodiment as described above, the reinforcements 530B can position the bearing 220B in the axial direction. Also, the reinforcements 530B further improve the strength and the stiffness of the shaft portion 520, thereby further increasing the durability of the pivot mechanism.

Fourth Embodiment

Figure 12A:
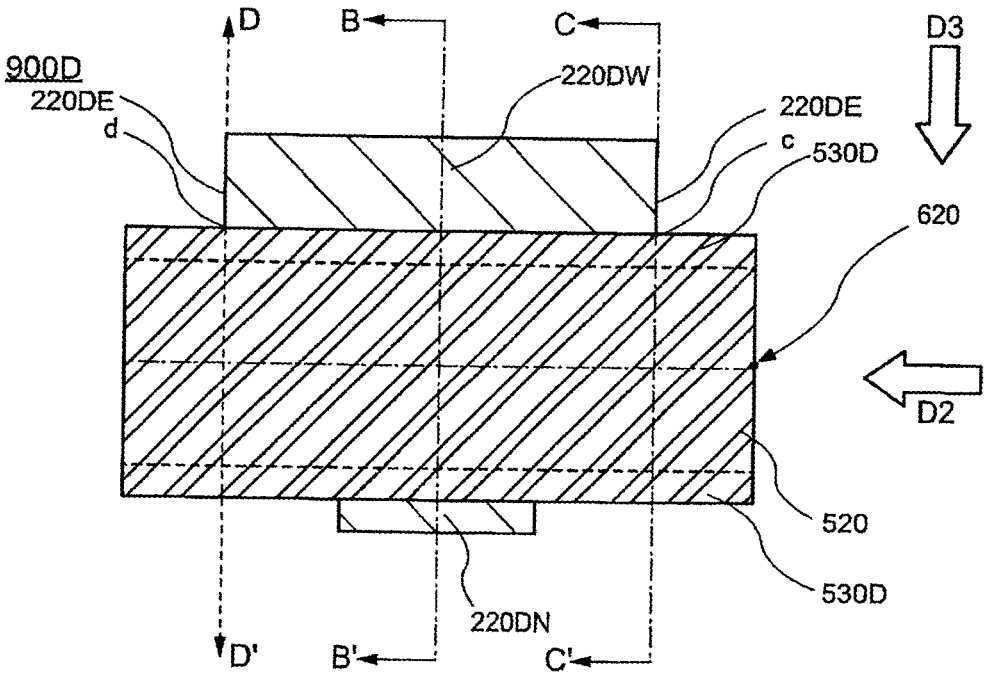
FIGS. 12A through 12C are cross-sectional views of a pivot mechanism in one embodiment of the present disclosure.
Figure 12B:
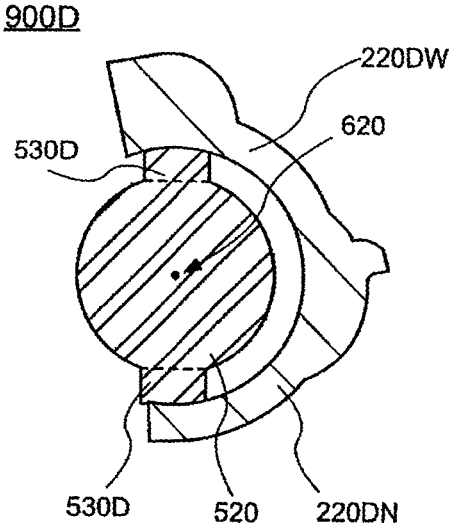

There will be described a pivot mechanism 900D according to a fourth embodiment which is different in configuration from the pivot mechanism 900 according to the first embodiment. FIGS. 12A through 12B are cross-sectional views of the pivot mechanism according to the one embodiment of the present disclosure. The shape of reinforcements 530D in the pivot mechanism 900D according to the fourth embodiment is different from that of the reinforcements 530 in the first embodiment. It is noted that the same reference numerals as used in the first embodiment are used to designate the corresponding elements of the fourth embodiment, and an explanation of which is dispensed with.

Figure 12C:
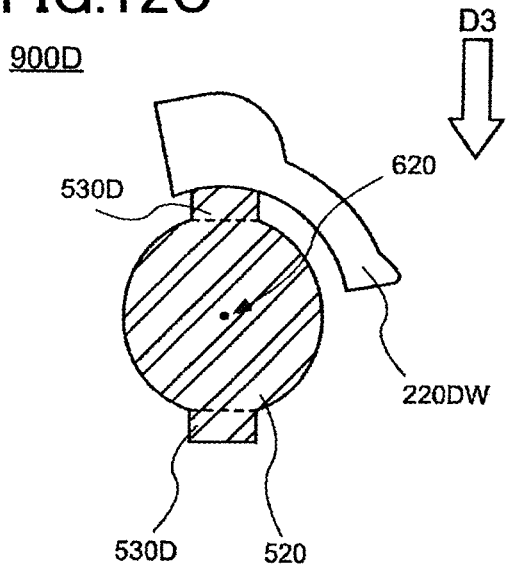

FIGS. 12A through 12C are cross-sectional views of the pivot mechanism according to the one embodiment of the present disclosure. FIG. 12A is a cross-sectional view of the pivot mechanism 900D according to the present embodiment which is viewed in the longitudinal direction of the key. FIG. 12B is a cross-sectional view taken along line B-B' in the axial direction in FIG. 12A and viewed in the D2 direction. FIG. 12C is a cross-sectional view taken along line C-C' in the axial direction in FIG. 12A and viewed in the D2 direction. FIGS. 12A through 12C illustrate the shaft portion 520 and a bearing 220D.

In FIG. 12A, the shaft portion 520 includes the reinforcements 530D protruding on a side nearer to a bearing 220DW having a larger width and on a side nearer to a bearing 220DN having a smaller width, so as to support the outer circumferential surface of the shaft portion 520 at least at opposite ends of the bearing 220DW having the larger width. That is, the shaft portion 520 includes the reinforcements 530D protruding respectively in the direction in which load is applied from the bearing 220D and in a direction opposite to the load direction. In the range of pivotal movement of the bearing 220D with respect to the shaft portion 520, the reinforcements 530D protrude respectively in the load direction (the D3 direction) and the direction opposite to the load direction (the direction opposite to the D3 direction), from a region in which load is applied to the shaft portion 520 and from the boundaries c, d of the region in the axial direction. In other words, in the range of pivotal movement of the bearing 220D with respect to the shaft portion 520, each of the reinforcements 530D extends in the axial direction to the outside of the bearing 220DW from a corresponding one of: the region in which the inner circumferential surface of the opening of the bearing 220D applies load to the shaft portion 520 (the third region between c and d on the side nearer to the bearing 220DW); and a region (a fourth region between c and d on the side nearer to the bearing 220DN) not including a region contacted by the bearing 220 in a region opposed via the pivot axis 620 to the third region. Each of the reinforcements 530D is a protrusion connected to the outer circumferential surface of the shaft portion 520 and protruding to the outside of the shaft diameter of the shaft portion 520.

In FIG. 12A, for example, the shaft portion 520 receives load from the bearing 220D in the up and down direction on the sheet of the drawing (the D3 direction). The shaft portion 520 receives particularly heavy stress from opposite end portions 220DE of the bearing 220DW having the larger width, at the boundaries c, d of the load-receiving region in the axial direction. The reinforcement 530D may protrude in the D3 direction from the outer circumferential surface of the shaft portion 520 which is contacted by the bearing 220DN. The reinforcement 530D may protrude in the direction opposite to the D3 direction from the outer circumferential surface of the shaft portion 520 which is contacted by the bearing 220DW. In this example, the pivot axis 620 of the bearing 220D is located at the substantially center of the shaft portion 520. However, the present disclosure is not limited to this configuration, and the pivot axis 620 of the bearing 220D may be displaced from the substantially center of the shaft portion 520.

FIG. 12B is a view illustrating the cross section taken along line B-B' in the axial direction at a central portion of the bearing 220D. The bearing 220D supports the shaft portion 520 so as to position the shaft portion 520 to a region inside the opening 630. The inner circumferential surface of the opening 630 of the bearing 220D (the bearing 220DW and the bearing 220DN) contacts only the reinforcements 530D at the central portion of the bearing 220D in the axial direction. That is, the bearing 220D contacts only the reinforcements 530D and does not contact the shaft portion 520 in the range of the pivotal movement of the bearing 220D relative to the reinforcements 530D. FIG. 12C is a view illustrating the cross section taken along line C-C' in the axial direction at a central portion of the bearing 220D. At the axial end portion 220DE of the bearing 220D, the inner circumferential surface of the opening 630 of the bearing 220D (the bearing 220DW) contacts the reinforcement 530D at a region that applies load to the shaft portion 520 (the C side). The reinforcement 530D connected to the shaft portion 520 is located in a region (the C' side) opposed via the pivot axis 620 to a region in which the shaft portion 520 receives load from the bearing 220D. This configuration enables arrangement of the reinforcements 530D on the shaft portion 520 without interfering with pivotal movement of the bearing 220D relative to the shaft portion 520. The reinforcements 530D extending respectively in the load direction (the D3 direction) and in the direction opposite to the load direction (the direction opposite to the D3 direction) can be disposed on the shaft portion 520 at the boundary c of the region that receives particularly heavy stress from the bearing 220D.

Figure 13:
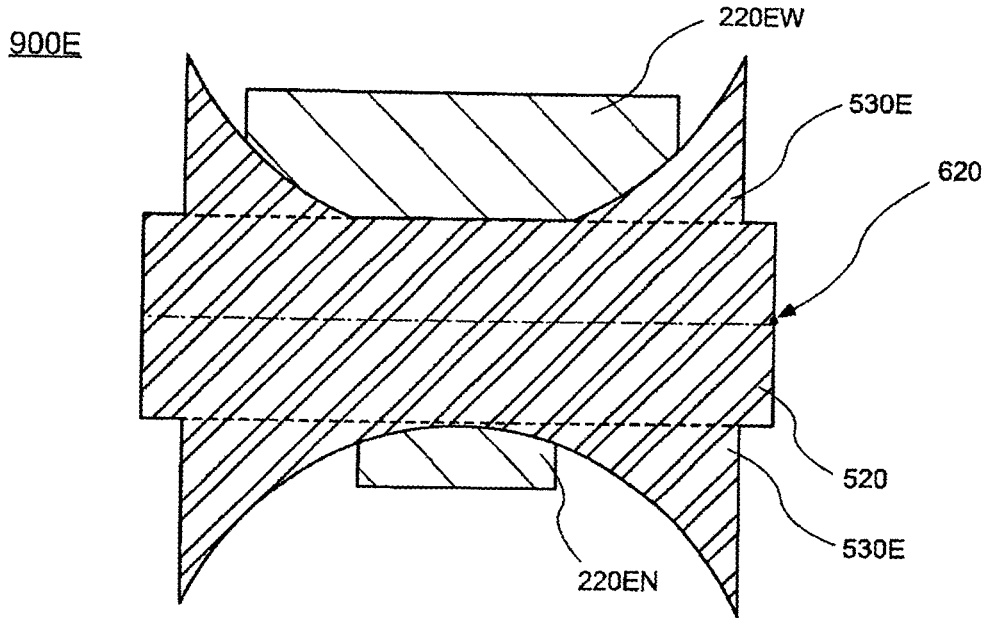
FIG. 13 is a cross-sectional view of a pivot mechanism in one embodiment of the present disclosure.

In FIG. 12A, the reinforcements 530D are provided so as to protrude respectively in the load direction (the D3 direction) and in the direction opposite to the load direction (the direction opposite to the D3 direction) from the boundaries c, d of the region in which the bearing 220D applies load to the shaft portion 520. However, the present disclosure is not limited to this configuration, and the number, the shapes, and the positions of the reinforcements 530D are not limited as long as pivotal movement of the bearing 220D relative to the shaft portion 520 is not interfered. The shape of the reinforcements 530D may be symmetric with respect to the axial direction. In FIG. 12A, each of the reinforcements 530D is shaped like a rectangular flat plate having the same height in the axial direction of the bearing 220D. However, the present disclosure is not limited to this configuration, and the number, the shape, and the position of each of the reinforcements 530D are not limited as long as pivotal movement of the bearing 220D relative to the shaft portion 520 is not interfered, and the reinforcement 530D is connected to the shaft portion 520 stably. As illustrated in FIG. 13, for example, reinforcements 530E may protrude on opposite sides of a bearing 220EW and on opposite sides of a bearing 220EN. Each of the reinforcements 530E may be shaped like an arc flat plate. In this case, each of the bearings 220EW, 220EN may have an arc surface extending along an arc of a corresponding one of the reinforcements. Each of the reinforcements 530 may be shaped like any of a polygonal cylinder, a circular cylinder, and a ball, for example.

In the pivot mechanism 900D according to the present embodiment as described above, the reinforcements 530D further improve the strength and the stiffness of the shaft portion 520, thereby further increasing the durability of the pivot mechanism.

Fifth Embodiment

Figure 14A:
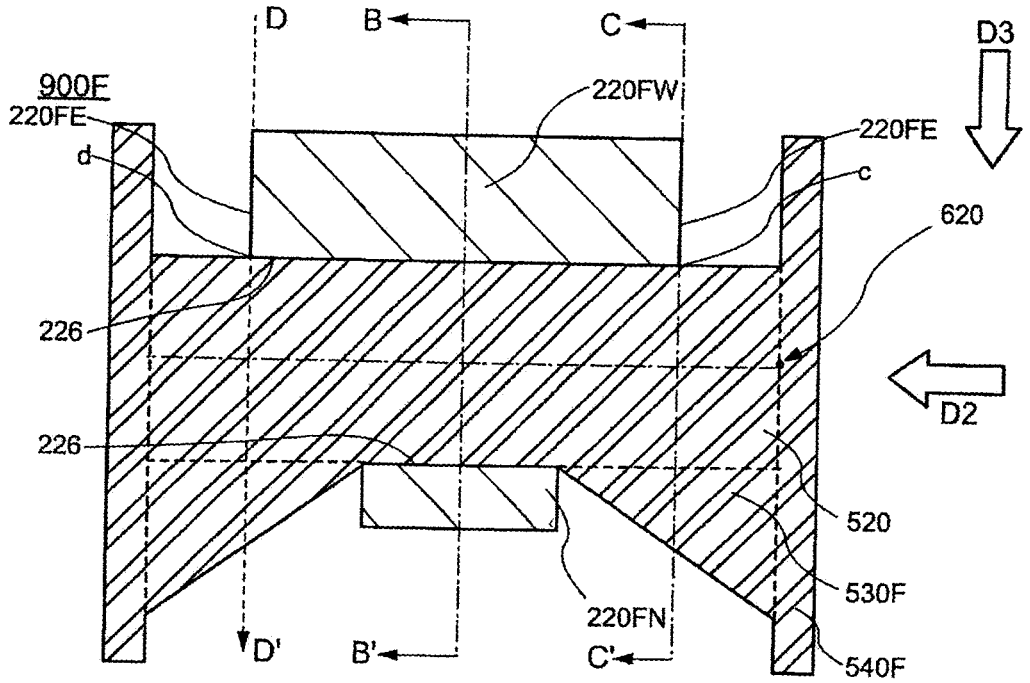
FIGS. 14A through 14C are cross-sectional views of a pivot mechanism in one embodiment of the present disclosure.
Figure 14B:
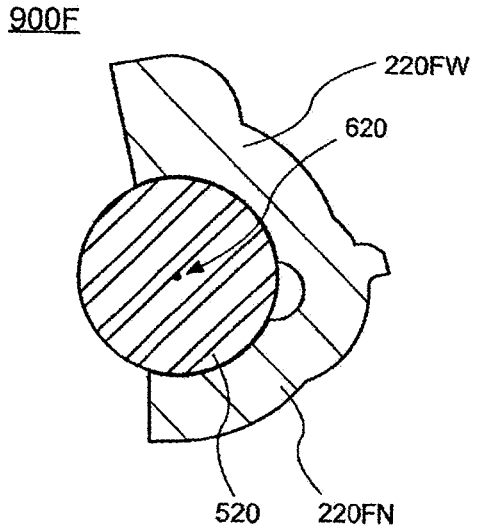
Figure 14C:
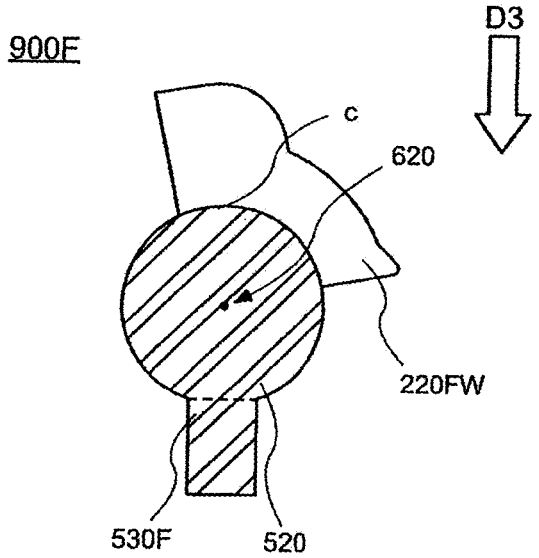

There will be described a pivot mechanism 900F according to a fifth embodiment which is different in configuration from the pivot mechanism 900 according to the first embodiment. FIGS. 14A through 14C are cross-sectional views of the pivot mechanism according to the one embodiment of the present disclosure. The pivot mechanism 900F according to the fifth embodiment is different from the pivot mechanism 900 according to the first embodiment in the shape of reinforcements 530F and in that the reinforcements 530F are connected respectively to shaft supporters 540F. It is noted that the same reference numerals as used in the first embodiment are used to designate the corresponding elements of the fifth embodiment, and an explanation of which is dispensed with.

FIGS. 14A through 14C are cross-sectional views of the pivot mechanism according to the one embodiment of the present disclosure. FIG. 14A is a cross-sectional view of the pivot mechanism 900F according to the present embodiment which is viewed in the longitudinal direction of the key. FIG. 14B is a cross-sectional view taken along line B-B' in the axial direction in FIG. 14A and viewed in the D2 direction. FIG. 14C is a cross-sectional view taken along line C-C' in the axial direction in FIG. 14A and viewed in the D2 direction. FIGS. 14A through 14C illustrates the shaft portion 520 and the bearing 220.

In FIG. 14A, the shaft portion 520 includes the reinforcements 530F protruding on a side nearer to a bearing 220FN having a smaller width, so as to support the outer circumferential surface of the shaft portion 520 at least at opposite ends of a bearing 220FW having a larger width. That is, the shaft portion 520 includes the reinforcements 530F protruding in the direction in which load is applied from the bearing 220F. The reinforcements 530F protrude in the load direction (the D3 direction) respectively from boundaries c, d, in the axial direction, of a region of the shaft portion 520 which receives load, in the range of pivotal movement of the bearing 220FW with respect to the shaft portion 520. In other words, in the range of pivotal movement of the bearing 220FW with respect to the shaft portion 520, each of the reinforcements 530F extends in the axial direction to the outside of the bearing 220FW from a corresponding one of portions of a region (a fourth region between c and d on the side nearer to the bearing 220FN) opposed via the pivot axis 620 to the region in which the inner circumferential surface of the opening of the bearing 220FW applies load to the contact surface 226 (the third region between c and d on the side nearer to the bearing 220FW). Each of the reinforcements 530F is a protrusion connected to the outer circumferential surface of the shaft portion 520 and protruding to a position outside the shaft diameter of the shaft portion 520. The shaft portion 520 is connected to the shaft supporters 540F in the axial end portion. The reinforcements 530F are connected at their respective axial end portions to the respective shaft supporters 540F. It is noted that the protruding height of each of the reinforcements 530F increases with decrease in distance to a corresponding one of the shaft supporters 540F.

In FIG. 14A, for example, the shaft portion 520 receives load from the bearing 220 in the up and down direction on the sheet of the drawing (the D3 direction). The shaft portion 520 receives particularly heavy stress from opposite end portions 220FE of the bearing 220FW having the larger width, at the boundaries c, d of the load-receiving region in the axial direction. The reinforcements 530F may protrude in the D3 direction from the outer circumferential surface of the shaft portion 520 which is contacted by the bearing 220FN. In this example, the pivot axis 620 of the bearing 220 is located at the substantially center of the shaft portion 520. However, the present disclosure is not limited to this configuration, and the pivot axis 620 of the bearing 220 may be displaced from the substantially center of the shaft portion 520.

FIG. 14B is a view illustrating the cross section taken along line B-B' in the axial direction at a central portion of the bearing 220. The bearing 220 supports the shaft portion 520 so as to position the shaft portion 520 to a region inside the opening 630. The inner circumferential surface of the opening 630 of the bearing 220 (the bearing 220FW and the bearing 220FN) contacts the outer circumferential surface of the shaft portion 520 at a broader region (a greater range of an angle viewed from the center of the shaft) at the central portion of the bearing 220 in the axial direction than at the axial end portion 220FE of the bearing 220. FIG. 14C is a view illustrating the cross section taken along line C-C' in the axial direction at an end portion of the bearing 220. At each of the axial end portions 220E of the bearing 220W, the inner circumferential surface of the opening 630 of the bearing 220 (the bearing 220FW) contacts the shaft portion 520 mainly at the region that applies load to the shaft portion 520. The reinforcements 530F connected to the shaft portion 520 are located at the respective regions opposed via the pivot axis 620 to the region in which the shaft portion 520 receives load from the bearing 220. This configuration enables arrangement of the reinforcements 530F on the shaft portion 520 without interfering with pivotal movement of the bearing 220 relative to the shaft portion 520. The reinforcement 530F extending in the load direction (the D3 direction) can be disposed on the shaft portion 520 at the boundary c of the region that receives particularly heavy stress from the bearing 220.

In FIG. 14A, the reinforcements 530F are provided so as to protrude in the load direction (the D3 direction) respectively from the boundaries c, d of the region in which the bearing 220 applies load to the shaft portion 520. The reinforcements 530F are connected at their respective axial end portions to the respective shaft supporters 540F. However, the present disclosure is not limited to this configuration, and the number of the reinforcements 530F may be any number as long as pivotal movement of the bearing 220 relative to the shaft portion 520 is not interfered. The shape of each of the reinforcements 530F may be symmetric with respect to the center (B-B') in the axial direction. In FIG. 14A, each of the reinforcements 530F is shaped like a triangle flat plate. However, the present disclosure is not limited to this configuration, and each of the reinforcements 530F may have any shape as long as pivotal movement of the bearing 220 relative to the shaft portion 520 is not interfered, and the reinforcement 530F is connected to the shaft portion 520 and the shaft supporters 540F stably. For example, the reinforcement 530F may be shaped like a polygonal or arc flat plate and may be shaped like any of a polygonal cylinder, a circular cylinder, and a ball, for example. The configuration in which the reinforcements 530F are connected to the respective shaft supporters 540F may be applied to the other embodiments of the present disclosure as needed.

In the pivot mechanism 900F according to the present embodiment as described above, the configuration in which the reinforcements 530F are connected to the respective shaft supporters 540F further improves the strength and the stiffness of the shaft portion 520, thereby further increasing the durability of the pivot mechanism.

In the above-described embodiments, the electronic piano is taken as one example of the keyboard apparatus to which the hammer assembly is applied. The hammer assemblies according to the above-described embodiments may be applied to a pivot mechanism of acoustic pianos (e.g., a ground piano and an upright piano). For example, the opening mechanisms in the above-described embodiments may be applied to a pivot mechanism of an upright piano which includes a pivot component and a supporter configured to support the pivot component pivotably. In this case, a sound producing mechanism corresponds to a hammer and a string. The pivot mechanisms according to the above-described embodiments may be applied to pivot components in instruments other than the piano.

It is to be understood that the present disclosure is not limited to the illustrated embodiments, but may be embodied with various changes and modifications, without departing from the spirit and scope of the disclosure.

What is claimed is:

1. A pivot mechanism, comprising:

a shaft portion;

a bearing configured to contact the shaft portion and pivot about a pivot axis; and a reinforcement protruding from an outer circumferential surface of the shaft portion, the outer circumferential surface comprising a first region contactable by the bearing in a range of pivotal movement thereof and a second region not comprising the first region in a region opposed to the first region via the pivot axis, the reinforcement extending from at least a portion of the second region to an outside of the bearing in a pivot-axis direction.

2. The pivot mechanism according to claim 1, wherein the bearing comprises a first receiver and a second receiver that contact the shaft portion at different positions in a pivotal direction, wherein a first end and a second end of the second receiver as opposite ends thereof in the pivot-axis direction are located between a first end and a second end of the first receiver as opposite ends thereof in the pivot-axis direction, and wherein the outer circumferential surface of the shaft portion comprises a third region contactable by the first receiver in a range of pivotal movement thereof and a fourth region not comprising the first region in a region opposed to the third region via the pivot axis, and the reinforcement extends from at least a portion of the fourth region to the outside of the bearing in the pivot-axis direction.

3. The pivot mechanism according to claim 1, wherein the bearing comprises a first receiver and a second receiver that contact the shaft portion at different positions in a pivotal direction, and wherein the outer circumferential surface of the shaft portion comprises a third region contactable by the first receiver in a range of pivotal movement thereof, and the reinforcement is provided at a position intersecting an imaginary plane that is perpendicular to the pivot axis and that contains an end portion of the third region in the pivot-axis direction.

4. The pivot mechanism according to claim 1, wherein the reinforcement is a protrusion protruding to a position outside a shaft diameter of the shaft portion.

5. The pivot mechanism according to claim 1, further comprising a shaft supporter configured to support the shaft portion, wherein the reinforcement is connected to the shaft supporter.

6. The pivot mechanism according to claim 2, wherein the bearing comprises a plurality of first receivers each as the first receiver.

7. The pivot mechanism according to claim 6, wherein the first receiver is located at opposite ends of the bearing in the pivot-axis direction.

8. The pivot mechanism according to claim 1, wherein the reinforcement comprises: a portion protruding from the second region; and a portion protruding from a region located outside the bearing in the pivot-axis direction when viewed from the second region.

9. The pivot mechanism according to claim 1, wherein the bearing comprises a first end and a second end in the pivot-axis direction, and wherein a portion of the reinforcement protrudes from an inner region interposed between the first end and the second end in the pivot-axis direction, and another portion of the reinforcement protrudes from an outer region not interposed between the first end and the second end in the pivot-axis direction.

10. The pivot mechanism according to claim 1, further comprising a shaft supporter connected to an end portion of the shaft portion in the pivot-axis direction and configured to support the shaft portion, wherein the reinforcement is connected to the shaft supporter.

11. A pivot mechanism, comprising:

a shaft portion;

a bearing configured to contact an outer circumferential surface of the shaft portion and pivot about a pivot axis; and a reinforcement protruding from the outer circumferential surface of the shaft portion in a direction orthogonal to a pivot-axis direction, wherein the reinforcement is configured such that a position, in the pivot-axis direction, of a boundary of a region in which the outer circumferential surface of the shaft portion contacts the bearing is located between a first end and a second end of the reinforcement in the pivot-axis direction.

12. A keyboard apparatus, comprising:

a key;

a hammer assembly configured to, in response to pressing of the key, pivot about a pivot mechanism comprising (i) a shaft portion, (ii) a bearing configured to contact the shaft portion and pivot about a pivot axis, and (iii) a reinforcement protruding from an outer circumferential surface of the shaft portion, the outer circumferential surface comprising a first region contactable by the bearing in a range of pivotal movement thereof and a second region not comprising the first region in a region opposed to the first region via the pivot axis, the reinforcement extending from at least a portion of the second region to an outside of the bearing in a pivot-axis direction;

a sensor disposed below the key and configured to detect an operation on the key; and a sound source section configured to produce a sound waveform signal in response to an output signal of the sensor.

13. The keyboard apparatus according to claim 12, wherein the outer circumferential surface of the shaft portion comprises a fifth region that receives load from the bearing in response to pressing of the key, and the reinforcement extends to an outside of the bearing in the pivot-axis direction from at least a portion of a region opposed to the fifth region via the pivot axis.

* * * * *